US010423087B2

(12) United States Patent
Iguchi et al.

(10) Patent No.: US 10,423,087 B2
(45) Date of Patent: Sep. 24, 2019

(54) ELECTROSTATIC CHARGE IMAGE DEVELOPING TONER AND ELECTROSTATIC CHARGE IMAGE DEVELOPER

(71) Applicant: FUJI XEROX CO., LTD., Tokyo (JP)

(72) Inventors: Moegi Iguchi, Kanagawa (JP); Sakon Takahashi, Kanagawa (JP); Soutaro Kakehi, Kanagawa (JP); Yuka Yamagishi, Kanagawa (JP); Yutaka Saito, Kanagawa (JP); Mona Tasaki, Kanagawa (JP); Tsutomu Furuta, Kanagawa (JP); Tsuyoshi Murakami, Kanagawa (JP); Satoshi Kamiwaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/965,985

(22) Filed: Apr. 30, 2018

(65) Prior Publication Data

US 2019/0033737 A1 Jan. 31, 2019

(30) Foreign Application Priority Data

Jul. 28, 2017 (JP) ..... 2017-147243
Dec. 22, 2017 (JP) ..... 2017-246600

(51) Int. Cl.
*G03G 9/08* (2006.01)
*G03G 9/083* (2006.01)
*G03G 9/097* (2006.01)

(52) U.S. Cl.
CPC ..... *G03G 9/0832* (2013.01); *G03G 9/0819* (2013.01); *G03G 9/0833* (2013.01); *G03G 9/09708* (2013.01); *G03G 9/09716* (2013.01)

(58) Field of Classification Search
CPC ..... G03G 9/09708
USPC ..... 430/108.6
See application file for complete search history.

(56) References Cited

U.S. PATENT DOCUMENTS

| | | | | |
|---|---|---|---|---|
| 2010/0239971 | A1 | 9/2010 | Moriya et al. | |
| 2015/0037720 | A1 | 2/2015 | Tsuda et al. | |
| 2017/0212439 | A1* | 7/2017 | Srinivasan | G03G 9/0904 |
| 2018/0267416 | A1* | 9/2018 | Uchino | G03G 9/0825 |

FOREIGN PATENT DOCUMENTS

| | | |
|---|---|---|
| JP | 2007033485 | 2/2007 |
| JP | 2008058463 | 3/2008 |
| JP | 2010044113 | 2/2010 |
| JP | 2011137980 | 7/2011 |

(Continued)

OTHER PUBLICATIONS

"Search Report of Europe Counterpart Application", dated Nov. 16, 2018, p. 1-p. 5.

*Primary Examiner* — Mark A Chapman
(74) *Attorney, Agent, or Firm* — JCIPRNET

(57) ABSTRACT

An electrostatic charge image developing toner includes: a toner particle and a strontium titanate particle that is externally added to the toner particle, in which an average primary particle diameter of the strontium titanate particle that is present on a surface of the toner particle is 30 nm or more and 100 nm or less, and average primary particle circularity is 0.82 or more and 0.94 or less, and in which circularity that becomes 84% of accumulation of the primary particle is greater than 0.92.

20 Claims, 3 Drawing Sheets

(56) References Cited

FOREIGN PATENT DOCUMENTS

| | | |
|---|---|---|
| JP | 2011203758 | 10/2011 |
| JP | 5166164 | 3/2013 |
| JP | 5248511 | 7/2013 |

* cited by examiner

ELECTROSTATIC CHARGE IMAGE DEVELOPING TONER AND ELECTROSTATIC CHARGE IMAGE DEVELOPER

CROSS-REFERENCE TO RELATED APPLICATIONS

This application is based on and claims priority under 35 USC 119 from Japanese Patent Application No. 2017-147243 filed Jul. 28, 2017 and Japanese Patent Application No. 2017-246600 filed Dec. 22, 2017.

BACKGROUND

Technical Field

The present invention relates to an electrostatic charge image developing toner and an electrostatic charge image developer.

SUMMARY

According to an aspect of the invention, there is provided an electrostatic charge image developing toner including: a toner particle; and a strontium titanate particle that is externally added to the toner particle, in which an average primary particle diameter of the strontium titanate particle that is present on a surface of the toner particle is 30 nm or more and 100 nm or less, and average primary particle circularity is 0.82 or more and 0.94 or less, and in which circularity that becomes 84% of accumulation of the primary particle is greater than 0.92.

BRIEF DESCRIPTION OF THE DRAWINGS

Exemplary embodiment(s) of the present invention will be described in detail based on the following figures, wherein.

DETAILED DESCRIPTION

Figure 1A:
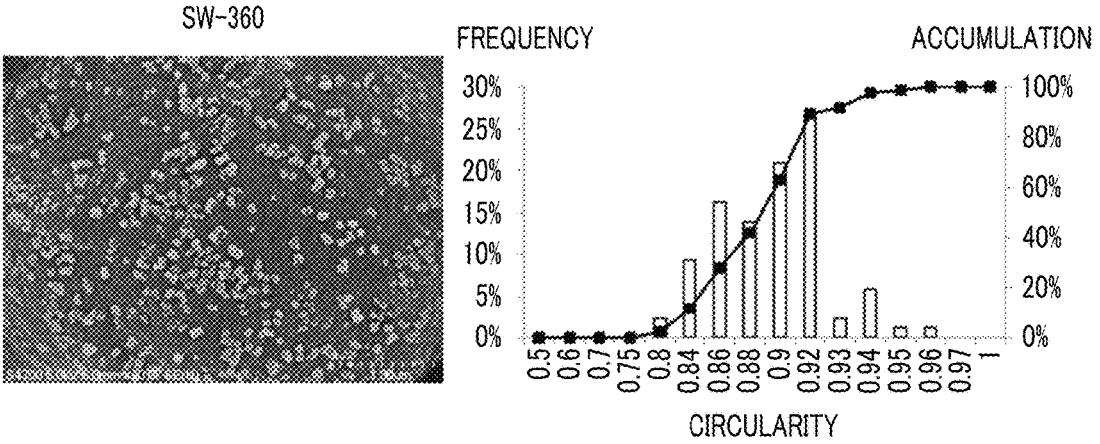
FIG. 1A is an SEM image of a toner obtained by externally adding SW-360 manufactured by Titan Kogyo, Ltd. which is an example of a strontium titanate particle and a graph of circularity distribution of strontium titanate particle obtained by analyzing the SEM image.

Hereinafter, exemplary embodiments of the present invention are described. These descriptions and examples exemplify the exemplary embodiments and do not limit the scope of the invention.

In the present disclosure, in a case of referring to the amount of each component in the composition, in a case where there are plural kinds of substances corresponding to each component in the composition, unless described otherwise, the amount means a total amount of plural substances.

In the present specification, the numerical range expressed by using "to" means a range including numerical values described before and after "to" as a lower limit value and an upper limit value.

In this disclosure, an "electrostatic charge image developing toner" is simply referred to a toner, and an "electrostatic charge image developer" is simply referred to as a "developing agent".

Electrostatic Charge Image Developing Toner

A toner according to this exemplary embodiment includes a toner particle and a strontium titanate particle that is externally added to the toner particle. That is, the toner according to this exemplary embodiment includes a toner particle and a strontium titanate particle which is an external additive.

With respect to the toner according to this exemplary embodiment, an average primary particle diameter of a strontium titanate particle that is present on a surface of a toner particle is 30 nm or more and 100 nm or less, average primary particle circularity is 0.82 or more and 0.94 or less, circularity that becomes 84% of accumulation of the primary particle is more than 0.92.

Hereinafter, a strontium titanate particle that is present on the surface of the toner particle, in which an average primary particle diameter is 30 nm or more and 100 nm or less, average primary particle circularity is 0.82 or more and 0.94 or less, and circularity that becomes 84% of accumulation of the primary particle is more than 0.92 is referred to as a "specific strontium titanate particle".

The strontium titanate particle has a charging behavior close to that of titanium oxide in view of an element composition thereof. Particularly, since the strontium element has a charge suppression effect in low humidity, the strontium titanate particle including the strontium element may be a material with less difference depending on the humidity environment compared with the titanium oxide.

Meanwhile, since the strontium titanate particle has a perovskite crystal structure and is a cube or a rectangle, in a case where the strontium titanate particle is externally added to the toner particle, dispersibility to the toner particle is bad. The strontium titanate particle which is a cube or a rectangle is present on the surface of the toner particles in a state in which corners are pierced, it is assumed that charges are concentrated at corners of the exposed strontium titanate particle during triboelectric charging, and thus the rising of charging of the toner is deteriorated. Particularly, in a case where a low density image is output at low temperature and low humidity (for example, 10° C. and 15% RH), the rise of charging of toner easily deteriorates. As a result, fogging occurs in the image immediately after the rise of the image forming device.

On the other hand, even in a case where a cubic or rectangular shape collapses, in a case where the particle diameter is small, the particle is easily buried in the toner particle, and thus fogging occurs.

As a result of intensive studies, the present inventors have found that, with respect to the strontium titanate particle present on the surface of the toner particles, focusing on three shape properties of the average primary particle diameter, the average primary particle circularity, and the circularity which becomes 84% of the accumulation of the primary particle, the occurrence of the fogging is suppressed by controlling the shape properties.

The three shape properties exhibit that the strontium titanate particle is present on the surface of the toner particles in a state with excellent dispersibility and is present in a state in which the corners are small.

From the above, it is considered that in the toner according to this exemplary embodiment, since the strontium titanate particle is present on the surface of the toner particle in a state that the corners are less exposed and dispersibility is excellent, the strontium titanate particles may suppress the fogging occurring in the image immediately after the rise of the image forming device.

Specific Strontium Titanate Particle

Average Primary Particle Diameter

The average primary particle diameter of the specific strontium titanate particle is 30 nm or more and 100 nm or less, preferably 30 nm or more and 80 nm or less, and more preferably 30 nm or more and 60 nm or less.

In a case where the average primary particle diameter of the specific strontium titanate particle is 30 nm or more and, burying of the specific strontium titanate particle in the toner particle is suppressed, fogging occurred in an image before and after the rise of the image forming device is easily suppressed. In a case where the average primary particle diameter of the specific strontium titanate particle is 100 nm or less, the surface coverage of the toner particle may be easily increased, and fogging occurring in the image immediately after the rise of the image forming device may be easily suppressed.

In a case where the average primary particle diameter of the specific strontium titanate particle is in the range, the strontium titanate particle used as the external additive may also have a small diameter. Therefore, in a case where the average primary particle diameter is within the above range, the strontium titanate particle having a small diameter may be present on the surface of the toner particle in a state in which dispersibility is excellent.

The primary particle diameter of specific strontium titanate particle is the diameter (so-called circle equivalent diameter) of a circle having an area the same as the primary particle image, and the average primary particle diameter of specific strontium titanate particles is a particle diameter which becomes 50% of accumulation from the small diameter side in the distribution of primary particle diameters based on the number.

The primary particle diameter of the specific strontium titanate particle is obtained by imaging an SEM image of a toner to which the strontium titanate particle is externally added and by performing image analysis on at least 300 points of the strontium titanate particle on the toner particle in an SEM image. Specific measuring methods are described in the [Examples] described below.

That the specific strontium titanate particle is present on the surface of the toner particle in a state in which dispersibility is excellent may be confirmed from this SEM image.

The average primary particle diameter of the specific strontium titanate particles may be controlled by adjusting the average primary particle diameter of the strontium titanate particle used as an external additive.

The average primary particle diameter of the strontium titanate particle used as an external additive may be controlled, for example, by various conditions in a case where the strontium titanate particle is manufactured by a wet production method.

In the specific strontium titanate particle, the average primary particle circularity is 0.82 or more and 0.94 or less, and the circularity which becomes 84% of the accumulation of the primary particle is more than 0.92.

Hereinafter, relating to the strontium titanate particle, the average primary particle circularity is also referred to as "average circularity" and the circularity that becomes 84% of the accumulation of the primary particle is also referred to as "accumulation 84% circularity".

In a case where the average circularity and the cumulative 84% circularity are in the above ranges, the strontium titanate particle may be present in a state in which there are few corners on the surface of the toner particle (the reason is described below). Therefore, it is considered that fogging is suppressed in the image immediately after the rise of the image forming device, which is caused by the concentration of charges at the corners of the strontium titanate particle.

In a case where the specific average circularity and the cumulative 84% circularity of the specific strontium titanate particle are in the above range, the strontium titanate particle used as an external additive may also have a shape in which corners are rounded. Therefore, compared with the case of using strontium titanate particle of a cube or a rectangle as the external additive, the strontium titanate particle having a shape in which corners are rounded may be present in the state in which dispersibility is excellent on the surface of the toner particle.

In this exemplary embodiment, the primary particle circularity of the strontium titanate particle is 4n×(area of primary particle image)/(circumference length of primary particle image)$^2$, the average primary particle circularity is circularity that becomes 50% of the accumulation from the smaller side in the circularity distribution, and the circularity that becomes 84% of accumulation of the primary particle is circularity that becomes 84% of the accumulation from the smaller side in the circularity distribution.

The circularity of the specific strontium titanate particle is obtained by imaging an SEM image of a toner to which the strontium titanate particle is externally added and by performing image analysis on at least 300 points of the strontium titanate particle on the toner particle in an SEM image. Specific measuring methods are described in the [Examples] described below.

The cumulative 84% circularity in the specific strontium titanate particle is one of the indices of a rounded shape. This cumulative 84% circularity is described.

FIG. 1A is an SEM image of a toner obtained by externally adding SW-360 manufactured by Titan Kogyo, Ltd. which is an example of a strontium titanate particle and a graph of circularity distribution of strontium titanate particle obtained by analyzing the SEM image. As illustrated in the SEM image, in SW-360, a major particle shape is a cube, and rectangle particles and spherical particles having a relatively small particle diameter are mixed. The circularity distribution of SW-360 of this example is concentrated between 0.84 and 0.92, the average circularity is 0.888, and the cumulative 84% circularity is 0.916. It is considered that this is a reflection that the major particle shape of SW-360 is a cube, a projected image of the cube is a regular hexagon (circularity of about 0.907), a flat hexagon, a square (circularity of about 0.785), and a rectangle, a cubic strontium titanate particle adheres to the toner particles with a corner, and the projected image mostly becomes hexagonal.

According to the fact that the actual circularity distribution of SW-360 is as described above, from the theoretical circularity of the projected image of the solid, with respect to the cubic or rectangular strontium titanate particle, it is assumed that the cumulative 84% circularity of the primary particle is less than 0.92.

Figure 1B:
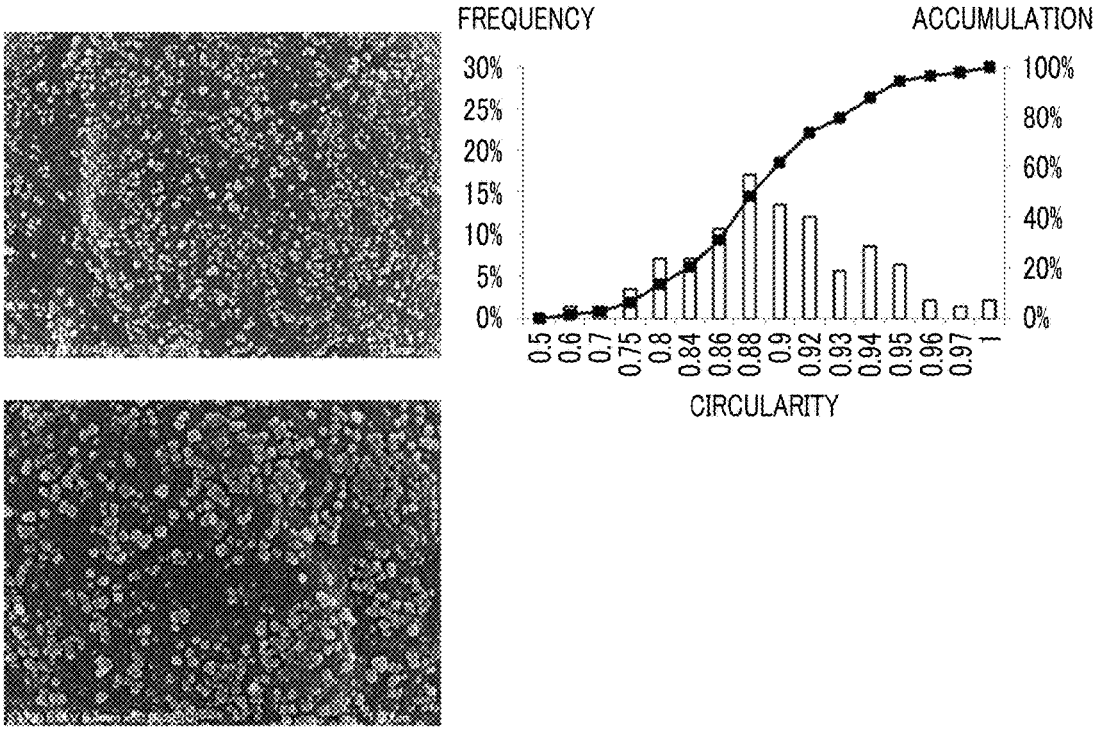
FIG. 1B is an SEM image of a toner obtained by externally adding another strontium titanate particle and a graph of circularity distribution of strontium titanate particle obtained by analyzing the SEM image.

Meanwhile, FIG. 1B is two SEM images (two of which magnifications are different, and the SEM image at the bottom in FIG. 1B is an SEM image with higher magnification) of toner obtained by externally adding another strontium titanate particle, and is a graph of the circularity distribution of the strontium titanate particle obtained by analyzing the SEM image. As presented by the two SEM images (particularly, the SEM image at the bottom of FIG. 1B), the strontium titanate particle of this example has a rounded shape. In the strontium titanate particle of this example, the average circularity is 0.883, and the cumulative 84% circularity is 0.935.

From the above, the cumulative 84% circularity in the specific strontium titanate particle is one of the indices of a rounded shape, and in a case where the cumulative 84% circularity is more than 0.92, the shape may be rounded.

In view of suppressing the fogging that occurs in the image immediately after the rise of the image forming device, the average circularity of the specific strontium titanate particle is 0.82 or more and 0.94 or less, more preferably 0.84 or more and 0.94 or less, and even more preferably 0.86 or more and 0.92 or less.

The average circularity and the cumulative 84% circularity of the specific strontium titanate particle may be controlled by adjusting the average circularity and the cumulative 84% circularity of the strontium titanate particle used as the external additive.

The average circularity and the cumulative 84% circularity of the strontium titanate particle used as the external additive may be, for example, controlled by various conditions at the time of manufacturing the strontium titanate particle by a wet process, doped metal elements of metal elements other than titanium and strontium, and doping amounts thereof.

Standard Deviation

In this exemplary embodiment, with respect to the strontium titanate particle that is present on the surface of the toner particle, the standard deviation of the primary particle circularity is preferably 0.04 or more and 2.0 or less, more preferably 0.04 or more and 1.0 or less, and even more preferably 0.04 or more and 0.50 or less.

The cubic or rectangular strontium titanate particle tends to have narrow circle distribution due to the shape thereof. Therefore, the strontium titanate particle in which the standard deviation of the primary particle circularity is in the range becomes an index indicating of not being a strontium titanate particle including a large amount of cubes or rectangles.

Therefore, the strontium titanate particle in which the standard deviation of the primary particle circularity is in the range is present in a state in which there are few corners on the surface of the toner particle, fogging that occurs since electric charges are concentrated at the corners of the strontium titanate particle in an image immediately after the rise of the image forming device is easily suppressed.

The standard deviation of the primary particle circularity is a standard deviation of the circularity of at least 300 strontium titanate particles on the toner particles that are subjected to the image analysis in a case where the circularity is obtained.

The measuring of the standard deviation of the primary particle circularity is performed at the same time of measuring of the average circularity and the cumulative 84% circularity.

In a case where the standard deviation of the circularity is calculated, the analysis is performed while a strontium titanate particle having a primary particle of 20 nm or less is removed.

Surface Coverage

In this exemplary embodiment, with respect to the strontium titanate particle that is present on the surface of the toner particle, the surface coverage thereof is preferably 3% or more and 50% or less and more preferably 3% or more and 30% or less.

In a case where the surface coverage of the strontium titanate particle with respect to the toner particle is 5% or more, the action by the strontium titanate particle is effectively exhibited, and the fogging of the image immediately after the rise of the image forming device is easily suppressed. In a case where the surface coverage of the strontium titanate particle with respect to the toner particle is 50% or less, leakage of charging of the toner becomes conspicuous under high temperature and high humidity, and occurring of fogging due to the failure of securing a sufficient charge amount of the toner may be suppressed.

The surface coverage of the strontium titanate particle with respect to the toner particles may be obtained by using the SEM image used in the measuring of the average circularity and the cumulative 84% circularity and using an area analysis tool of image processing analysis software WinROOF (manufactured by Mitani Corporation) on this SEM image.

Strontium Titanate Particle

Hereinafter, the strontium titanate particle used as the external additive is described.

With respect to the strontium titanate particle used as the external additive in order to obtain the average primary particle diameter of the specific strontium titanate particle, the average primary particle diameter is preferably 30 nm or more and 100 nm or less, more preferably 30 nm or more and 80 nm or less, and even more preferably 30 nm or more and 60 nm or less.

In a case where the average primary particle diameter is 30 nm or more, the burying in the toner particle is suppressed, and in a case where the average primary particle diameter is 100 nm or less, the surface coating amount of the toner particle is easily increased.

As the strontium titanate particle used as the external additive in order to satisfy the average circularity and the cumulative 84% circularity of the specific strontium titanate particle, the strontium titanate particle having a rounded shape is preferably used.

For example, with respect to the strontium titanate particle used as the external additive, the average circularity is preferably 0.82 or more and 0.94 or less, more preferably 0.84 or more and 0.94 or less, and even more preferably 0.86 or more and 0.92 or less.

In a case where the average circularity is 0.82 or more, the dispersibility to the toner particle is easily increased, and in a case where the average circularity is 0.94 or less, the mobility of the toner particle on the surface decreases, and thus the homogeneous dispersibility of the surface is easily increased.

With respect to the strontium titanate particle used as the external additive, the half value width of the peak of the (110) plane obtained by the X-ray diffraction method is preferably 0.2° or more and 2.0° or less.

The peak of the (110) plane obtained by the X-ray diffraction method of the strontium titanate particle is a peak that appears near the diffraction angle $2\theta=32°$. This peak corresponds to a peak of the (110) plane of a perovskite crystal.

The strontium titanate particle having the particle shape of a cube or a rectangle has high crystallity of the perovskite crystal, and the half value of the peak of the (110) plane is generally less than 0.2°. For example, in a case where SW-350 manufactured by Titan Kogyo, Ltd. (strontium titanate particle of which the major particle shape is a cube) is analyzed, the half value of the peak of the (110) plane is 0.15°.

Meanwhile, with respect to the strontium titanate particle in the rounded shape, the crystallity of the perovskite crystal is relatively low, and the half value of the peak of the (110) plane expands.

It is preferable that the strontium titanate particle used as the external additive has a rounded shape. As one of the indices of the rounded shape, the half value of the peak of the (110) plane is preferably 0.2° or more and 2.0° or less, more preferably 0.2° or more and 1.0° or less, and even more preferably 0.2° or more and 0.5° or less.

The X-ray diffraction of the strontium titanate particles is performed by using an X-ray diffractometer (for example, trade name: RINT Ultima-III, manufactured by Rigaku Corporation). The settings of the measurement are Line source CuKα, voltage 40 kV, current 40 mA, sample rotation speed: no rotation, divergence slit: 1.00 mm, divergence vertical limit slit: 10 mm, scattering slit: open, receiving slit: open, scanning mode: FT, counting time: 2.0 seconds, step width: 0.0050°, and operation axis: 10.0000° to 70.0000°. The half value of the peak in the X-ray diffraction pattern in this disclosure is full width at half maximum.

It is preferable that the strontium titanate particle used as the external additive is doped with a metal element (hereinafter, also referred to as a dopant) other than titanium and strontium. In a case where the strontium titanate particle includes a dopant, the crystallity of the perovskite structure is decreased, and the shape becomes rounded.

The dopant of the strontium titanate particle is not particularly limited, as long as the dopant is a metal element other than titanium and strontium. A metal element having an ionic radius that can enter the crystal structure forming the strontium titanate particles in a case of being ionized is preferable. In this point of view, the dopant of the strontium titanate particle is a metal element having an ionic radius in a case of being ionized is 40 pm or more and 200 pm or less and more preferably a metal element having an ionic radius of 60 pm or more and 150 pm or less.

Specific examples of the dopant of the strontium titanate particle include lanthanoids, silica, aluminum, magnesium, calcium, barium, vanadium, chromium, manganese, iron, cobalt, nickel, copper, zinc, gallium, niobium, molybdenum, ruthenium, palladium, indium, antimony, tantalum, tungsten, rhenium, iridium, platinum, bismuth, yttrium, zirconium, niobium, silver, and tin. As the lanthanoid, lanthanum and cerium are preferable. Among these, from the viewpoint that the doping is easily performed, and the shape of the strontium titanate particle is easily controlled, lanthanum is preferable.

In view of not excessively negatively charging the strontium titanate particle, the dopant of the strontium titanate particle is preferably a metal element having electronegativity of 2.0 or less and more preferably a metal element having electronegativity of 1.3 or less. The electronegativity in this exemplary embodiment is Allred-Rochow electronegativity.

A satisfactory metal element as the metal element having the electronegativity of 2.0 or less is provided below together with electronegativity.

Examples of the metal element having an electronegativity of 2.0 or less include lanthanum (1.08), magnesium (1.23), aluminum (1.47), silica (1.74), calcium (1.04), vanadium (1.45), chromium (1.56), manganese (1.60), iron (1.64), cobalt (1.70), nickel (1.75), copper (1.75), zinc (1.66), gallium (1.82), yttrium (1.11), zirconium (1.22), niobium (1.23), silver (1.42), indium (1.49), tin (1.72), barium (0.97), tantalum (1.33), rhenium (1.46), and cerium (1.06).

With respect to an amount of the dopant in the strontium titanate particle, in view of causing the dopant to have a perovskite-type crystal structure and having a rounded shape, the dopant to strontium is preferably in the range of 0.1 mol % or more and 20 mol % or less, more preferably in the range of 0.1 mol % or more and 15 mol % or less, and even more preferably in the range of 0.1 mol % or more and 10 mol % or less.

With respect to the strontium titanate particle used as the external additive, the moisture content is preferably 1.5 mass % or more and 10 mass % or less. In a case where the moisture content is 1.5 mass % or more and 10 mass % or less (more preferably 2 mass % or more and 5 mass % or less), the resistance of the strontium titanate particles becomes in an appropriate range, and the occurring of fogging is further suppressed.

The above range of the moisture content of the strontium titanate particle is realized by manufacturing the strontium titanate particle by a wet process and adjusting the condition (temperature and time) of the drying treatment.

In the case of hydrophobizing the surface of the strontium titanate particles, the range may be realized by adjusting the conditions of the drying treatment after the hydrophobic treatment.

The moisture content of the strontium titanate particles is measured as follows.

After 20 mg of the measurement sample is left for 17 hours in a chamber having a temperature of 22° C. and a relative humidity of 55% so as to be humidified, the measurement sample is heated from 30° C. to 250° C. at a temperature rise rate of 30° C./min in a nitrogen gas atmosphere by a thermobalance (TGA-50 type manufactured by Shimadzu Corporation) in a room at a temperature of 22° C./relative humidity of 55%, and a heating loss (mass lost by heating) is measured.

The moisture content is calculated by the following formula based on the measured heating loss.

Moisture content(mass %)=(Heating loss from 30° C. to 250° C.)/(mass after humidification before heating)×100

In view of improving the action of the strontium titanate particle, the strontium titanate particle used as the external additive is preferably a strontium titanate particle having a hydrophobized surface and more preferably a strontium titanate particle having a hydrophobized surface by a silicon-containing organic compound.

Examples of the silicon-containing organic compound include an alkoxysilane compound, a silazane compound, and silicone oil. Among these, at least one selected from an alkoxysilane compound and silicone oil is preferable.

The silicon-containing organic compound is specifically described in the section of the method of manufacturing the strontium titanate particle.

The strontium titanate particle used as the external additive preferably has a surface including a silicon-containing organic compound by 1 mass % or more and 50 mass % or less (preferably 5 mass % or more and 40 mass % or less, more preferably 5 mass % or more and 30 mass % or less, and even more preferably 10 mass % or more and 25 mass % or less) with respect to the mass of the strontium titanate particle.

That is, the hydrophobic treatment amount by the silicon-containing organic compound is preferably 1 mass % or more and 50 mass % or less, more preferably 5 mass % or more and 40 mass % or less, even more preferably 5 mass % or more and 30 mass % or less, and particularly preferably 10 mass % or more and 25 mass % or less with respect to the mass of the strontium titanate particle.

In a case where the amount of the hydrophobic treatment amount is 1 mass % or more, the charge amount of the toner can be secured even under high temperature and high humidity, and occurring of fogging is easily suppressed. In a case where the hydrophobic treatment amount is 50 mass % or less, the saturated charging amount of the toner does not become too large even under low temperature and low humidity, and occurring of fog is easily suppressed. In a case where the hydrophobic treatment amount is 30 mass % or less, the generation of aggregates due to this hydrophobized surface is easily suppressed.

With respect to the hydrophobized surface of the strontium titanate particle, in view of improving the action of the strontium titanate particle, the mass ratio (Si/Sr) of silicon (Si) and strontium (Sr) calculated from qualitative and quantitative analysis by fluorescent X-ray analysis is preferably 0.025 or more and 0.25 or less and more preferably 0.05 or more and 0.20 or less.

Here, the fluorescent X-ray analysis of the hydrophobized surface of the strontium titanate particles is performed by the following method.

That is, qualitative and quantitative analysis measurement is performed by using a fluorescent X-ray analyzer (XRF 1500 manufactured by Shimadzu Corporation) under conditions of X-ray output of 40 V, 70 mA, measurement area of 10 mmcp, and measurement time of 15 minutes. Here, the analyzed elements are oxygen (O), silicon (Si), titanium (Ti), strontium (Sr), and metal elements (Me) other than titanium and strontium, and mass ratios (%) of respective elements are calculated with reference to calibration curve data and the like which may quantify the respective elements separately prepared from the total of the measured elements.

The mass ratio (Si/Sr) is calculated based on the value of a mass ratio of silicon (Si) and a mass ratio of strontium (Sr) that may be obtained in this measurement.

With respect to the strontium titanate particle used as the external additive, in view of charging performances of the toner and suppressing of occurring of the fogging, volume intrinsic resistivity R1 (Ω·cm) is preferably 11 or more and 14 or less, more preferably 11 or more and 13 or less, and even more preferably 12 or more and 13 or less with respect to a common logarithm value log R1.

A volume intrinsic resistivity R1 of the strontium titanate particle is measured as follows.

A strontium titanate particle is put on a lower electrode plate of a measuring holding device which is a pair of circular electrode plates (made of steel) of 20 $cm^2$ which are connected to an electrometer (KEITHLEY 610C, manufactured by KEITHLEY, Inc.) and a high voltage power supply (FLUKE 415 B) so as to form a flat layer having a thickness of 1 mm or more and 2 mm or less.

Thereafter, the formed strontium titanate particle layer is humidified at 22° C. and 55% RH for 24 hours.

Next, in the environment of 22° C. and 55% RH, an upper electrode plate is disposed on the humidified strontium titanate particle layer, 4 kg of a weight is placed on the upper electrode plate in order to remove a cavity in the strontium titanate particle layer, and the thickness of the strontium titanate particle layer is measured in that state. Next, a voltage of 1,000 V is applied to both the electrode plates, and the current value is measured, so as to calculate the volume intrinsic resistivity R1 from Equation (1).

$$\text{Volume intrinsic resistivity } R1(\Omega\cdot\text{cm}) = V \times S/(A1 - A0)/d \quad \text{Equation (1):}$$

In Equation (1), V is an applied voltage of 1,000 (V), S is an electrode plate area of 20 ($cm^2$), A1 is a measured current value (A), A0 is an initial current value (A) in a case where an applied voltage is 0 V, and d is a thickness (cm) of the strontium titanate particle layer.

The volume intrinsic resistivity R1 of the strontium titanate particle used as the external additive may be controlled, for example, by volume intrinsic resistivity R2 (R2 is changed by a moisture content, a type of a dopant, a dopant amount, and the like) of the strontium titanate particle before the hydrophobic treatment, types of a hydrophobic treatment agent, a hydrophobic treatment amount, and a drying temperature and drying time after the hydrophobic treatment. It is preferable that the volume intrinsic resistivity R1 is controlled by any one of the moisture content of the strontium titanate particle before the hydrophobic treatment and the hydrophobic treatment amount.

The volume intrinsic resistivity R2 of the strontium titanate particle before the hydrophobic treatment is preferably 6 or more and 10 or less and more preferably 7 or more and 9 or less in a common logarithm value log R2. That is, the inside of the hydrophobized surface of the strontium titanate particle has the resistance, the inside of the strontium titanate particle has low resistance, and the surface is high resistance particles due to hydrophobic treatment. Accordingly, the charging performances of the toner are improved. In this exemplary embodiment, in view of securing image density by improving charging performances of the toner, a difference (log R1−log R2) between the common logarithm value log R1 of the volume intrinsic resistivity R1 and the common logarithm value log R2 of the volume intrinsic resistivity R2 is preferably 2 or more and 7 or less and more preferably 3 or more and 5 or less.

The volume intrinsic resistivity R2 of the strontium titanate particle before the hydrophobized surface is formed, for example, may be controlled according to a moisture content of the strontium titanate particle, a type of the dopant, a dopant amount, and the like.

The volume intrinsic resistivity R2 of the strontium titanate particle before the hydrophobic treatment is measured by a method the same as the volume intrinsic resistivity R1.

Method of Manufacturing Strontium Titanate Particle

The strontium titanate particle used as the external additive is manufactured by performing the hydrophobic treatment on the surface after the manufacturing of the strontium titanate particle, if necessary.

The method of manufacturing the strontium titanate particle is not particularly limited, but is preferably a wet process in view of controlling a particle diameter and a shape.

Manufacturing Strontium Titanate Particle

The wet process of the strontium titanate particle is a manufacturing method of performing reaction while an alkaline aqueous solution is added to a mixed solution of a titanium oxide source and a strontium source and then performing an acid treatment. In this manufacturing method, the particle diameter of the strontium titanate particles is controlled by a mixing ratio of the titanium oxide source and the strontium source, a concentration of the titanium oxide source at the initial stage of the reaction, the temperature and the addition rate at the time of adding the alkaline aqueous solution, and the like.

As a titanium oxide source, a mineral acid peptized product of a hydrolyzate of a titanium compound is preferable. Examples of the strontium source include strontium nitrate and strontium chloride.

The mixing ratio of the titanium oxide source and the strontium source is preferably 0.9 or more and 1.4 or less and more preferably 1.05 or more and 1.20 or less in a molar ratio of $SrO/TiO_2$. The concentration of the titanium oxide source in the initial stage of the reaction is preferably 0.05 mol/L or more and 1.3 mol/L or less and more preferably 0.5 mol/L or more and 1.0 mol/L or less as $TiO_2$.

In order to adjust the resistance of the strontium titanate particle, it is preferable to add a dopant source to the mixed solution of the titanium oxide source and the strontium source. Examples of the dopant source include an oxide of metal other than titanium and strontium. The metal oxide as the dopant source is added as a solution dissolved in, for example, nitric acid, hydrochloric acid, sulfuric acid, or the like. The addition amount of the dopant source is preferably an amount in which metal which is a dopant is 0.1 moles or more and 10 moles or less and more preferably an amount in which metal is 0.5 moles or more and 10 moles or less with respect to 100 moles of strontium.

The dopant source may be added in a case where the alkaline aqueous solution is added to the mixed solution of the titanium oxide source and the strontium source. Also in that case, the metal oxide of the dopant source may be added as a solution of being dissolved in nitric acid, hydrochloric acid, or sulfuric acid.

As the alkaline aqueous solution, a sodium hydroxide aqueous solution is preferable. There is a tendency in that, as the temperature at the time of adding the alkaline aqueous solution becomes higher, a strontium titanate particle having more satisfactory crystallinity can be obtained. In this exemplary embodiment, the temperature is preferably in the range of 60° C. or higher and 100° C. or lower.

With respect to the addition rate of the alkaline aqueous solution, as the addition rate is lower, the strontium titanate particle having a larger particle diameter may be obtained, and as the addition rate is higher, the strontium titanate particle having a smaller particle diameter may be obtained. The addition rate of the alkaline aqueous solution, for example, is 0.001 equivalent/h or more and 1.2 equivalent/h or less and appropriately 0.002 equivalent/h or more and 1.1 equivalent/h or less with respect to the introduced raw material.

After the alkaline aqueous solution is added, an acid treatment is performed for the purpose of removing the unreacted strontium source. The acid treatment, for example, is performed by using hydrochloric acid, and pH of the reaction solution is adjusted from 2.5 to 7.0 and more preferably from 4.5 to 6.0.

After the acid treatment, the reaction solution is subjected to solid-liquid separation, and the solid content is subjected to a dry treatment, so as to obtain a strontium titanate particle.

The moisture content of the strontium titanate particle is controlled by adjusting the condition of the drying treatment of the solid content.

In the case of hydrophobizing the surface of the strontium titanate particles, the moisture content may be controlled by adjusting the conditions of the drying treatment after the hydrophobic treatment.

For example, with respect to the drying condition in a case where the moisture content is controlled, the drying temperature is preferably 90° C. or higher and 300° C. or lower (preferably 100° C. or higher and 150° C. or lower), and the drying time is 1 hour or longer and 15 hours or shorter (preferably 5 hours or longer and 10 hours or shorter).

Hydrophobic Treatment

The hydrophobic treatment on the surface of the strontium titanate particle is performed, for example, by preparing a treatment liquid obtained by mixing a solvent and a silicon-containing organic compound that is a hydrophobic treatment agent, mixing the strontium titanate particle and the treatment liquid under stirring, and further performing stirring continuously.

After the surface treatment, the drying treatment is performed for the purpose of removing the solvent of the treatment liquid.

Examples of the silicon-containing organic compound that is a hydrophobic treatment agent include an alkoxysilane compound, a silazane compound, and silicone oil.

Examples of the alkoxysilane compound which is a hydrophobic treatment agent include tetramethoxysilane and tetraethoxysilane; methyltrimethoxysilane, ethyl trimethoxysilane, propyl trimethoxysilane, butyl trimethoxysilane, hexyltrimethoxysilane, n-octyltrimethoxysilane, decyltrimethoxysilane, dodecyltrimethoxysilane, vinyl triethoxysilane, methyltriethoxysilane, ethyltriethoxysilane, butyl triethoxysilane, hexyltriethoxysilane, decyltriethoxysilane, dodecyltriethoxysilane, phenyltrimethoxysilane, o-methylphenyltrimethoxysilane, p-methylphenyltrimethoxysilane, phenyltriethoxysilane, and benzyltriethoxysilane; dimethyl dimethoxysilane, dimethyl diethoxysilane, methyl vinyl dimethoxysilane, methyl vinyl diethoxysilane, diphenyldimethoxysilane, and diphenyldiethoxysilane; trimethylmethoxysilane, and trimethylethoxysilane.

Examples of the silazane compound that is a hydrophobilizing agent include dimethyl disilazane, trimethyldisilazane, tetramethyldisilazane, pentamethyldisilazane, and hexamethyldisilazane.

Examples of the silicone oil which is the hydrophobic treatment agent include silicone oil such as dimethyl polysiloxane, diphenyl polysiloxane, and phenylmethyl polysiloxane; reactive silicone oil such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane.

Among these, as the hydrophobizing agent, in view of the charging environment difference and the improvement of fluidity, it is preferable to use an alkoxysilane compound. Particularly, in view of improving liquidity, butyltrimethoxysilane is preferable.

As the solvent used for preparing the treatment liquid, an alcohol (for example, methanol, ethanol, propanol, and butanol) is preferable in a case where the silicon-containing organic compound is an alkoxysilane compound or a silazane compound, and hydrocarbons (for example, benzene, toluene, normal hexane, and normal heptane) is preferable in a case where the silicon-containing organic compound is silicone oil.

In the treatment liquid, the concentration of the silicon-containing organic compound is preferably 1 mass % or more and 50 mass % or less, more preferably 5 mass % or more and 40 mass % or less, and even more preferably 10 mass % or more and 30 mass % or less.

As described above, the amount of the silicon-containing organic compound used in the hydrophobic treatment is preferably 1 mass % or more and 50 mass % or less, more preferably 5 mass % or more and 40 mass % or less, even more preferably 5 mass % or more and 30 mass % or less, and particularly preferably 10 mass % or more and 25 mass % or less with respect to the mass of the strontium titanate particle.

As above, the strontium titanate particle having the surface subjected to the hydrophobic treatment may be obtained.

External Addition Amount

The external addition amount of the strontium titanate particle is preferably 0.1 parts by mass or more and 5 parts by mass or less, more preferably 0.5 parts by mass or more and 3 parts by mass or less, and even more preferably 0.7 parts by mass or more and 2 parts by mass or less with respect to 100 parts by mass of the toner particle.

Particle Other than Strontium Titanate Particle

The toner relating to this exemplary embodiment may include a particle other than the strontium titanate as the external additive.

Examples of the other particle include other inorganic particles other than the strontium titanate particle.

Examples of the other inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

It is preferable that the surface of the inorganic particle as the external additive may be subjected to the hydrophobic treatment. For example, the hydrophobic treatment is performed by immersing an inorganic particle to the hydrophobic treatment agent, or the like. The hydrophobic treatment agent is not particularly limited, but examples thereof include a silane coupling agent, a silicone oil, a titanate coupling agent, and an aluminum coupling agent. These may be used singly or two or more kinds thereof may be used in combination.

The amount of the hydrophobic treatment agent is generally 1 part by mass or more and 10 parts by mass or less with respect to 100 parts by mass of the inorganic particle.

Examples of the other particle include a resin particle (a resin particle such as polystyrene, polymethyl methacrylate, and melamine resin) and a cleaning activator (for example, a particle of a fluorine-based high molecular weight substance).

In the additive according to this exemplary embodiment, in a case of including a particle other than the strontium titanate particle, the content of the particle other than the strontium titanate particle in the entire particle is preferably 15 mass % or less, more preferably 3 mass % or more and 10 mass % or less, and even more preferably 4 mass % or more and 8 mass % or less.

Toner Particle

Examples of the toner particle include a binder resin and, if necessary, a colorant, a release agent, and other additives.

In this exemplary embodiment, in addition to toner particle such as a yellow toner, a magenta toner, a cyan toner, or a black toner, examples of the toner particle include a white toner particle, a transparent toner particle, or a glitter toner particle, but the toner particle is not particularly limited.

Binder Resin

Examples of the binder resin include a homopolymer of a monomer such as styrenes (for example, styrene, parachlorostyrene, and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or a vinyl-based resin including a copolymer obtained by combining two or more of these monomers.

Examples of the binder resin include a non-vinyl based resin such as an epoxy resin, a polyester resin, a polyurethane resin, a polyamide resin, a cellulose resin, a polyether resin, and a modified rosin, a mixture of these and the vinyl-based resin, or a graft polymer obtained by polymerizing a vinyl-based monomer in the coexistence thereof.

These binder resins may be used singly or two or more kinds thereof may be used in combination.

As the binder resin, a polyester resin is preferable. Examples of the polyester resin include a condensation polymer of polyvalent carboxylic acid and polyhydric alcohol.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acid (such as cyclohexanedicarboxylic acid), aromatic dicarboxylic acid (for example, terephthalic acid, isophthalic acid, phthalic acid, and naphthalene dicarboxylic acid), anhydrides thereof, or lower alkyl ester (for example, having 1 to 5 carbon atoms) thereof. Among these, as the polyvalent carboxylic acid, for example, aromatic dicarboxylic acid is preferable.

As the polyvalent carboxylic acid, trivalent or higher valent carboxylic acid having a crosslinked structure or a branched structure may be used together with the dicarboxylic acid. Examples of the trivalent or higher valent carboxylic acid include trimellitic acid, pyromellitic acid, anhydrides thereof, or lower alkyl esters (for example, having 1 to 5 carbon atoms) thereof.

The polyvalent carboxylic acid may be used singly or two or more kinds thereof may be used in combination.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A and a propylene oxide adduct of bisphenol A). Among these, as the polyhydric alcohol, for example, aromatic diol or alicyclic diol is preferable, and aromatic diol is more preferable.

As the polyhydric alcohol, trihydric or higher hydric polyhydric alcohol having a crosslinked structure or a branched structure may be used together with diol. Examples of trihydric or higher hydric polyhydric alcohol include glycerin, trimethylolpropane, and pentaerythritol.

The polyhydric alcohol may be used singly or two or more kinds thereof may be used in combination.

The glass transition temperature (Tg) of the polyester resin is preferably 50° C. or more and 80° C. or less and more preferably 50° C. or more and 65° C. or less.

The glass transition temperature is calculated from the DSC curve obtained by the differential scanning calorimetry (DSC), more specifically, is obtained from "Extrapolated glass transition onset temperature" disclosed in the method of obtaining the glass of transition temperature of "Method of measuring transition temperature of plastic" of JIS K 7121-1987.

The weight-average molecular weight (Mw) of the polyester resin is preferably 5,000 or more and 1,000,000 or less and more preferably 7,000 or more and 500,000 or less. The number-average molecular weight (Mn) of the polyester resin is preferably 2,000 or more and 100,000 or less. The molecular weight distribution Mw/Mn of the polyester resin is preferably 1.5 or more and 100 or less and more preferably 2 or more and 60 or less.

The weight-average molecular weight and the number-average molecular weight of the polyester resin are measured by gel permeation chromatography (GPC). Measuring of the molecular weight by GPC is performed in a THF solvent by using GPC•HLC-8120 GPC manufactured by Tosoh Corporation as a measuring device and using TSK gel SuperHM-M (15 cm) manufactured by Tosoh Corporation. The weight-average molecular weight and the number-average molecular weight are calculated by using a molecular weight calibration curve prepared from a monodispersed polystyrene standard sample from this measurement result.

The polyester resin may be obtained by the well-known manufacturing method. Specifically, the polyester resin may be obtained, for example, by the method of setting the polymerization temperature to be 180° C. or more and 230° C. or less, depressurizing the inside of the reaction system if necessary, and performing the reaction while removing water and alcohol generated during the condensation.

In a case where the monomer of the raw material does not dissolve or compatibilize at the reaction temperature, a solvent having a high boiling point may be added as a dissolution aid for dissolving. In this case, the polycondensation reaction is performed while the dissolution aid is distilled off. In a case where a monomer with bad compatibility is present, the monomer having bad compatibility and the acid or alcohol to be polycondensed with the monomer may be condensed with each other in advance, so as to be polycondensed with the major component.

The content of the binder resin is preferably 40 mass % or more and 95 mass % or less, more preferably 50 mass % or more and 90 mass % or less, and even more preferably 60 mass % or more and 85 mass % or less with respect to the entire toner particle.

The content of the binder resin in a case where the toner particle is a white toner particle is preferably 30 mass % or more and 85 mass % or less, more preferably 40 mass % or more and 60 mass % or less with respect to the entire white toner particle.

Colorant

Examples of the colorant include pigments such as carbon black, chrome yellow, hansa yellow, benzidine yellow, suren yellow, quinoline yellow, pigment yellow, permanent orange GTR, pyrazolone orange, vulcan orange, watch young red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; pigments such as titanium oxide, zinc oxide, calcium carbonate, basic lead carbonate, a zinc sulfide-barium sulfate mixture, zinc sulfide, silicon dioxide, or aluminum oxide; and dyes such as acridine-based, xanthene-based, azo-based, benzoquinone-based, azine-based, anthraquinone-based, thioindigo-based, dioxazine-based, thiazine-based, azomethine-based, indico-based, phthalocyanine-based, aniline black-based, polymethine-based, triphenyl methane-based, diphenylmethane-based, and thiazole-based dyes.

In a case where the toner particle us a white toner particle, a white pigment may be used as the colorant.

As the white pigment, titanium oxide and zinc oxide are preferable, and titanium oxide is more preferable.

The colorant may be used singly or two or more kinds thereof may be used in combination.

As the colorant, if necessary, a surface-treated colorant may be used or a dispersing agent may be used in combination.

The content of the colorant is preferably 1 mass % or more and 30 mass % or less and more preferably 3 mass % or more and 15 mass % or less with respect to the entire toner particle.

The content of a white pigment in a case where the toner particle is a white toner particle, is preferably 15 mass % or more and 70 mass % or less, and more preferably 20 mass % or more and 60 mass % or less with respect to the entire white toner particles.

Releasing Agent

Examples of the release agent include hydrocarbon wax; natural wax such as carnauba wax, rice wax, and candelilla wax; synthetic or mineral/petroleum wax such as montan wax; and ester type wax such as fatty acid ester and montanic acid ester. The releasing agent is not limited thereto.

The melting temperature of the releasing agent is preferably 50° C. or more and 110° C. or less and more preferably 60° C. or more and 100° C. or less.

The melting temperature is calculated from the DSC curve obtained by the differential scanning calorimetry (DSC) by "Melting peak temperature" disclosed in the method of obtaining the melting temperature of "Method of measuring transition temperature of plastic" of JIS K 7121-1987.

The content of the releasing agent is preferably 1 mass % or more and 20 mass % or less and more preferably 5 mass % or more and 15 mass % or less with respect to the entire toner particle.

Other Additives

Examples of other additives include well-known additives such as a magnetic material, a charge control agent, and an inorganic powder. These additives are included in the toner particle as an internal additive.

Properties of Toner Particle

The toner particle may be a toner particle of a single layer structure or may be a toner particle of a so-called core-shell structure including a core part (core particle) and a coating layer (shell layer) coating the core part. The toner particle of a core-shell structure, for example, includes a core part including a binder resin and, if necessary, a colorant, a releasing agent, and the like, and a coating layer including a binder resin.

The volume average particle diameter (D50v) of the toner particle is preferably 2 μm or more and 10 μm or less and more preferably 4 μm or more and 8 μm or less.

The volume average particle diameter of the toner particle is measured using COULTER MULTISIZER II (manufactured by Beckman Coulter, Inc.) and using ISOTON-II (manufactured by Beckman Coulter, Inc.) as an electrolytic solution.

In the measurement, 0.5 mg or more and 50 mg or less of a measurement sample is added to 2 ml of a 5 mass % aqueous solution of a surfactant (preferably sodium alkylbenzenesulfonate) as a dispersing agent. This is added to 100 ml or more and 150 ml or less of the electrolytic solution.

A dispersion treatment of the electrolytic solution in which the sample is suspended was performed for one minute with an ultrasonic disperser, and each of the particle diameters of the particle having a particle diameter in the range of 2 μm to 60 μm is measured by using an aperture of 100 μm by Coulter Multisizer II. The number of sampling particles is 50,000.

With respect to the measured particle diameter, the cumulative volume-based distribution is drawn from the small diameter side, and the particle diameter at which the accumulation becomes 50% is defined as the volume average particle diameter D50v.

In this exemplary embodiment, the average circularity of the toner particles is not particularly limited, but in view of improving the cleaning properties of the toner from the image holding member, the average circularity is preferably 0.91 or more and 0.98 or less, more preferably 0.94 or more and 0.98 or less, and even more preferably 0.95 or more and 0.97 or less.

The strontium titanate particle in a rounded shape having a small diameter may be dispersed on the surface of the toner particles without uneven distribution of the strontium titanate particle. The same is applied to a case of using toner particles in the irregular shape, and the strontium titanate particles may be distributed in an almost uniform state on the surface of the toner particles without uneven distribution to a fine concave portion.

That is, even in a case where this toner particle in the irregular shape is used, the configuration of the toner according to this exemplary embodiment may be obtained, and fogging occurring in the image immediately after the start of the image forming device may be suppressed.

It is obvious that, even in a case where spherical toner particles having an average circularity of more than 0.98 are used, the configuration of the toner according to this exemplary embodiment may be obtained, and the fogging occurring in the image immediately after the start of the image forming device may be suppressed.

In this exemplary embodiment, the circularity of the toner particle is the (circumference length of a circle having area the same as the particle projected image)/(circumference length of the particle projected image), and the average circularity of the toner particle is a circularity that becomes 50% of the accumulation from the smaller side in the circularity distribution. The average circularity of the toner particle is obtained by analyzing at least 3,000 toner particles by a flow-type particle image analyzer. Specific measuring methods are described in the [Examples] described below.

In a case where the toner particles are manufactured, for example, by the coagulation coalescence method, the average circularity of the toner particles may be by adjusting the stirring speed of the dispersion, the temperature of the dispersion, or retention time in the coagulation coalescence process.

Method of Manufacturing Toner

Subsequently, a method of manufacturing the toner according to this exemplary embodiment is described.

The toner according to this exemplary embodiment may be obtained by externally adding an external additive to the toner particle after the toner particle is manufactured.

The toner particle may be manufactured by any one of a dry process (for example, a kneading pulverization method) and a wet process (for example, a coagulation coalescence method, a suspension polymerization method, and a dissolution suspension method). These processes are not particularly limited, and well-known processes are employed. Among these, toner particles may be obtained by a coagulation coalescence method.

Specifically, for example, in a case where toner particles are manufactured by a coagulation coalescence method, the toner particles are manufactured through a step of (a resin particle dispersion preparation step) of preparing a resin particle dispersion in which resin particles to be a binder resin are dispersed, a step of aggregating the resin particles (other particles, if necessary) in the resin particle dispersion (in a dispersion after other particles are mixed, if necessary) to form aggregated particles, and a step (coagulation/coalescence step) of heating the aggregated particle dispersion in which the aggregated particles are dispersed, and coagulating and coalescing the aggregated particles to form toner particles.

Hereinafter, respective steps are described.

In the following description, a method for obtaining toner particles including a colorant and a releasing agent is described, but a colorant and a releasing agent are used, if necessary. It is obvious that, other additives other than the colorant and the releasing agent may be used.

Resin Particle Dispersion Preparation Step

Together with the resin particle dispersion in which resin particles to be a binder resin are dispersed, for example, a colorant particle dispersion in which colorant particles are dispersed and a releasing agent particle dispersion in which releasing agent particles are dispersed are prepared.

The resin particle dispersion is prepared, for example, by dispersing resin particles in a dispersion medium by a surfactant.

Examples of the dispersion medium used for the resin particle dispersion include an aqueous medium.

Examples of the aqueous medium include water such as distilled water and ion exchanged water and alcohols. These may be used singly or two or more kinds thereof may be used in combination.

Examples of the surfactant include an anionic surfactant such as sulfate ester salt-based, sulfonate-based, phosphate ester-based, and soap-based surfactants; a cationic surfactant such as amine salt-based and quaternary ammonium salt-based surfactants; and a nonionic surfactant such as polyethylene glycol-based, alkylphenol ethylene oxide adduct-based, and polyhydric alcohol-based surfactants. Among these, particularly, an anionic surfactant and a cationic surfactant are exemplified. The nonionic surfactant may be used together with an anionic surfactant and a cationic surfactant.

The surfactant may be used singly or two or more kinds thereof may be used in combination.

With respect to the resin particle dispersion, examples of the method of dispersing the resin particles in a dispersion medium, for example, include a general dispersing method such as a rotary shearing type homogenizer, a ball mill, a sand mill, and a dyno mill having a medium. According to the types of the resin particle, the resin particles may be dispersed in the dispersion medium by a phase-transfer emulsification method. The phase-transfer emulsification method is a method of dissolving the resin to be dispersed in a hydrophobic organic solvent in which the resin is soluble and performing phase inversion from W/O to O/W by performing neutralization by adding a base to an organic continuous phase (O phase) and introducing the aqueous medium (W phase), so as to disperse the resin in a particle form in an aqueous medium.

The volume average particle diameter of the resin particles dispersed in the resin particle dispersion, for example, is preferably 0.01 μm or more and 1 μm or less, more preferably 0.08 μm or more and 0.8 μm or less, and even more preferably 0.1 μm or more and 0.6 μm or less.

With respect to the volume average particle diameter of the resin particles, the particle diameter which becomes 50% of the accumulation with respect to all the particles is defined as the volume average particle diameter D50v is measured as the volume average particle diameter D50v, by subtracting the cumulative distribution from the small particle diameter side to the volume with respect to the particle size (channel) partitioned by using the particle size distribution obtained by measurement with a laser diffraction type particle size distribution determination device (for example, LA-700, manufactured by Horiba, Ltd.). The volume average particle diameter of the particles in other dispersions is measured in the same manner.

The content of the resin particle of the resin particle dispersion is preferably 5 mass % or more and 50 mass % or less and more preferably 10 mass % or more and 40 mass % or less.

In the same manner as the resin particle dispersion, for example, a colorant particle dispersion and a releasing agent particle dispersion are also prepared. That is, with regard to the volume average particle diameter of the particles in the resin particle dispersion, the dispersion medium, the dispersion method, and the content of the particles, the same is applied to the release agent particles dispersed in the colorant particles dispersed in the colorant particle dispersion and the releasing agent particle dispersion.

Aggregated Particle Forming Step

Subsequently, the resin particle dispersion, the colorant particle dispersion, and the release agent particle dispersion are mixed. In the mixed dispersion, the resin particles, the colorant particles, and the releasing agent particles are heteroaggregated and aggregated particles including the resin particles, the colorant particles, and the releasing agent particles which has a diameter close to the diameter of the preferable toner particle are formed.

Specifically, for example, an aggregating agent is added to the mixed dispersion, pH of the mixed dispersion is adjusted to acidity (for example, pH 2 or more and 5 or less), a dispersion stabilizer is added, if necessary, heating is performed to a temperature (specifically, for example, glass transition temperature of resin particles of −30° C. or more and glass transition temperature of −10° C. or less) close to the glass transition temperature of the resin particles, and the particles dispersed in the mixed dispersion are aggregated, so as to form aggregated particles.

In the aggregated particle forming step, for example, heating may be performed after adding an aggregating agent at room temperature (for example, 25° C.) under stirring stirred with a rotary shearing type homogenizer with a rotary shearing type homogenizer, adjusting pH of the mixed dispersion to acidity (for example, pH 2 or more and 5 or less), and adding the dispersion stabilizer, if necessary.

Examples of the aggregating agent include a surfactant having a polarity opposite to that of the surfactant included in the mixed dispersion, inorganic metal salt, and a divalent or higher valent metal complex. In a case where a metal complex is used as the aggregating agent, the amount of the surfactant used is reduced and the charging properties are improved.

Together with the aggregating agent, an additive that forms a complex or a similar bond with a metal ion of the aggregating agent may be used, if necessary. As the additive, a chelating agent may be preferably used.

Examples of the inorganic metal salt include metal salt such as calcium chloride, calcium nitrate, barium chloride, magnesium chloride, zinc chloride, aluminum chloride, and aluminum sulfate; and an inorganic metal salt polymer such as polyaluminum chloride, poly aluminum hydroxide, and calcium polysulfide polymer.

As the chelating agent, a water soluble chelating agent may be used. Examples of the chelating agent include oxycarboxylic acid such as tartaric acid, citric acid, and gluconic acid; and aminocarboxylic acid such as iminodiacetic acid (IDA), nitrilotriacetic acid (NTA), and ethylenediaminetetraacetic acid (EDTA).

The addition amount of the chelating agent is preferably 0.01 parts by mass or more and 5.0 parts by mass or less and more preferably 0.1 parts by mass or more and less than 3.0 parts by mass with respect to 100 parts by mass of the resin particle.

Coagulation Coalescence Step

Next, the aggregated particle dispersion in which the aggregated particles are dispersed is heated, for example, to be equal to or higher than the glass transition temperature of the resin particles (for example, higher than the temperature higher than the glass transition temperature of the resin particles by 10° C. to 30° C.), and the aggregated particles are coagulated and coalesced, so as to form the toner particles.

The toner particles may be obtained through the above steps.

The toner particles may be manufactured through a step of obtaining an aggregated particle dispersion in which the aggregated particles are dispersed, further mixing the aggregated particle dispersion and the resin particle dispersion in which the resin particles are dispersed, and aggregating such that the resin particles are further adhered to the surface of the aggregated particles, to form the second aggregated particles and a step of heating the second aggregated particle dispersion in which the second aggregated particles are dispersed, and coagulating and coalescing of the second aggregated particles, to form toner particles having a core-shell structure.

After completion of the coagulation coalescence step, a well-known washing step, a well-known solid-liquid separation step, and a well-known drying step are performed on to the toner particles formed in the solution, so as to obtain toner particles in a dry state. With respect to the washing step, in view of charging performances, displacement washing with ion exchanged water may be sufficiently performed. With respect to the solid-liquid separation step, in view of productivity, suction filtration, pressure filtration, and the like may be performed. With respect to the drying step, in view of productivity, freeze-drying, air stream drying, viscous flow drying, vibrating viscous drying, and the like may be performed.

Then, the toner according to this exemplary embodiment is manufactured, for example, by adding an external additive to the obtained toner particles in a dry state and performing mixing. The mixing may be performed, for example, a V blender, a HENSCHEL MIXER, or a LOEDIGE MIXER. If necessary, coarse particles of the toner may be removed by using a vibration sieving machine, an air sieve separator, or the like.

Electrostatic Charge Image Developer

The electrostatic charge image developer according to this exemplary embodiment at least includes the toner according to this exemplary embodiment. The electrostatic charge image developer according to this exemplary embodiment may be a single component developer including only the toner according to this exemplary embodiment and may be a double component developer obtained by mixing the toner and a carrier.

The carrier is not particularly limited, and examples thereof include well-known carriers. Examples of the carrier include a coated carrier in which the surface of a core formed of magnetic powder is coated with a resin; a magnetic powder dispersed carrier formulated by dispersing in which magnetic powder in a matrix resin; and a resin impregnated carrier in which porous magnetic powder is impregnated with a resin. The magnetic powder dispersion type carrier and the resin impregnated carrier may be a carrier in which constituent particles of the carrier are used as a core, and the surface is coated with a resin.

Examples of the magnetic powder include magnetic metal such as iron, nickel, and cobalt; and magnetic oxides such as ferrite and magnetite.

Examples of the resin for coating and the matrix resin include polyethylene, polypropylene, polystyrene, polyvinyl acetate, polyvinyl alcohol, polyvinyl butyral, PVC, polyvinyl ether, polyvinyl ketone, a vinyl chloride-vinyl acetate copolymer, a styrene-acrylic acid ester copolymer, a straight silicone resin including an organosiloxane bond, or modified products thereof, a fluorine resin, polyester, polycarbonate, a phenol resin, and an epoxy resin. Additives such as conductive particles may be included in the coating resin and the matrix resin. Examples of the conductive particles include particles of metal such as gold, silver, and copper, carbon black, titanium oxide, zinc oxide, tin oxide, barium sulfate, aluminum borate, and potassium titanate.

In order to coat the surface of the core with the resin, a method of applying the coating resin and a coating layer forming solution obtained by dissolving various additives (used, if necessary) in an appropriate solvent, and the like may be exemplified. The solvent is not particularly limited and may be selected considering the kind of resin to be used, coating suitability, and the like. Specific examples of the resin coating method include an immersion method of immersing the core in a coating layer forming solution; a spraying method of spraying a coating layer forming solution to the surface of the core material; a viscous flow bed method of spraying the coating layer forming solution in a state in which the core is suspended by viscous flow air; and a kneader coater method of mixing a core of a carrier and a coating layer forming solution in a kneader coater and then removing the solvent.

The mixing ratio (mass ratio) of the toner and the carrier in the double-component developer is preferably from toner: carrier=1:100 to 30:100 and more preferably from 3:100 to 20:100.

Image Forming Device and Image Forming Method

The image forming device and the image forming method according to this exemplary embodiment are described.

The image forming device according to this exemplary embodiment includes an image holding member, a charging unit that charges a surface of the image holding member, an electrostatic charge image forming unit that forms an electrostatic charge image on the charged surface of the image holding member, an developing unit that accommodates an electrostatic charge image developer and develops an electrostatic charge image formed on the surface of the image holding member by the electrostatic charge image developer as a toner image, a transfer unit that transfers a toner image formed on the surface of the image holding member to a surface of a recording medium, and a fixing unit that fixes the toner image transferred to the surface of the recording medium. As the electrostatic charge image developer, an electrostatic charge image developer according to this exemplary embodiment is applied.

In the image forming device according to this exemplary embodiment, an image forming method (the image forming according to this exemplary embodiment) including a charging step of charging a surface of the image holding member, an electrostatic charge image forming step of forming an electrostatic charge image on the charged surface of the image holding member, an developing step of developing an electrostatic charge image formed on the surface of the image holding member by the electrostatic charge image developer according to this exemplary embodiment as a toner image, a transfer step of transferring a toner image formed on the surface of the image holding member to a surface of a recording medium, and a fixing step of fixing the toner image transferred to the surface of the recording medium is performed.

With respect to the image forming device according to this exemplary embodiment, well-known image forming devices such as a device in a direct transfer method of directly transferring a toner image formed on a surface of an image holding member to a recording medium; a device in an intermediate transfer method of firstly transferring a toner image formed on a surface of an image holding member to a surface of an intermediate transfer member and secondarily transferring the toner image transferred to the surface of the intermediate transfer member to the surface of the recording medium; a device of including a cleaning unit that cleans the surface of the image holding member after transferring of the toner image and before charging; and a device of including a discharging unit that performs discharging by irradiating the surface of the image holding member with discharging light after the transferring of the toner image and before charging.

In a case where the image forming device according to this exemplary embodiment is a device in the intermediate transferring method, a configuration in which the transfer unit, for example, includes an intermediate transfer member in which a toner image is transferred to a surface, a primary transfer unit that firstly transfers the toner image formed on the surface of the image holding member to a surface of the intermediate transfer member, and a secondary transfer unit that secondarily transfers the toner image transferred to the surface of the intermediate transfer member to a surface of a recording medium is applied.

In the image forming device according to this exemplary embodiment, for example, a portion including a developing unit may be a cartridge structure (process cartridge) that is detachably attached to the image forming device. As the process cartridge, for example, a process cartridge including a developing unit that accommodates the electrostatic charge image developer according to this exemplary embodiment may be preferably used.

Hereinafter, an example of the image forming device according to this exemplary embodiment is described, but the present invention is not limited thereto. In the description below, major portions illustrated in the drawings are described, and explanation of the others is omitted.

Figure 2:
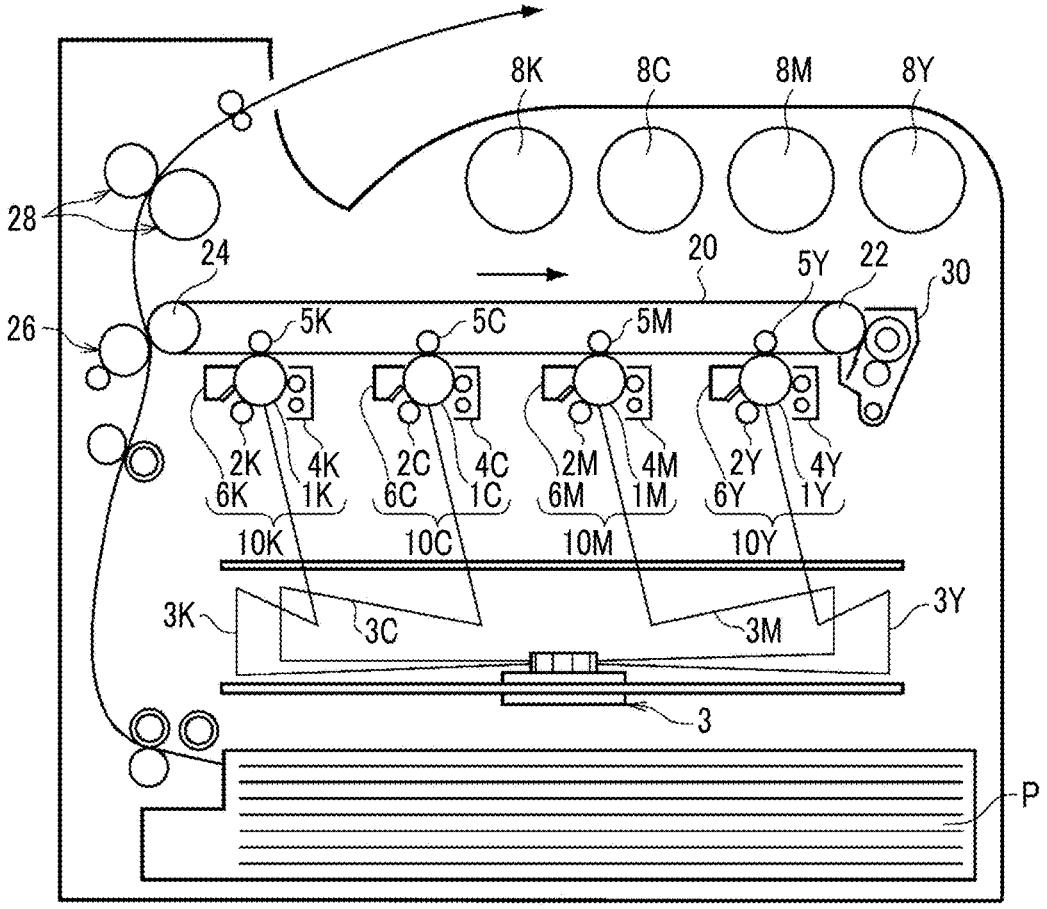
FIG. 2 is a schematic view illustrating a configuration of an image forming device of this exemplary embodiment.

FIG. 2 is a schematic view illustrating the image forming device according to this exemplary embodiment.

The image forming device illustrated in FIG. 2 includes first to fourth image forming units 10Y, 10M, 10C, and 10K (image forming units) of an electrophotographic method that output images of respective colors of yellow (Y), magenta (M), cyan (C), and black (K) based on color separated image data. These image forming units (hereinafter, simply referred to as "units") 10Y, 10M, 10C, and 10K are arranged to be parallel by being spaced in a predetermined distance from each other in a horizontal direction. These units 10Y, 10M, 10C, and 10K may be process cartridges that are detachably attached to the image forming device.

An intermediate transfer belt (an example of the intermediate transfer member) 20 is elongated on upper sides of the respective units 10Y, 10M, 10C, and 10K through the respective units. The intermediate transfer belt 20 is installed to wind a drive roller 22 and a support roller 24 that are in contact with an inner surface of the intermediate transfer belt 20 and is caused to drive in a direction from the first unit 10Y toward the fourth unit 10K. The force is applied to the support roller 24 in a direction of departing from the drive roller 22 by a spring or the like, such that tension is applied to the intermediate transfer belt 20. An intermediate transfer belt cleaning device 30 is provided on the image holding surface side of the intermediate transfer belt 20 to face the drive roller 22.

Respective toners of yellow, magenta, cyan, and black that are held in containers included in toner cartridges 8Y, 8M, 8C, and 8K are supplied to respective developing devices (an example of a developing units) 4Y, 4M, 4C, and 4K of the respective units 10Y, 10M, 10C, and 10K.

The first to fourth units 10Y, 10M, 10C, and 10K have identical configuration and movements, and thus the first unit 10Y that is installed on an upper stream side in the intermediate transfer belt driving direction and forms a yellow image is representatively described.

The first unit 10Y has a photoconductor 1Y that functions as an image holding member. Around the photoconductor 1Y, a charging roller (an example of the charging unit) 2Y that charges a surface of the photoconductor 1Y in a predetermined potential, an exposing device (an example of the electrostatic charge image forming unit) 3 that exposes the charged surface with laser beams 3Y based on a color separated image signal and forms an electrostatic charge image, a developing device (an example of the developing unit) 4Y that supplies a toner charged on an electrostatic charge image and develops an electrostatic charge image, a primary transfer roller (an example of the primary transfer unit) 5Y that transfers the developed toner image on the intermediate transfer belt 20, and a photoconductor cleaning device (an example of the image holding member cleaning unit) 6Y that removes the toner remaining on the surface of the photoconductor 1Y after primary transferring.

The primary transfer roller 5Y is disposed inside the intermediate transfer belt 20 and is provided at a position facing the photoconductor 1Y. Respective bias power supplies (not illustrated) that apply primary transfer bias are connected to the primary transfer rollers 5Y, 5M, 5C, and 5K of the respective units. The respective bias power supplies change the values of the transfer bias applied to the respective primary transfer rollers according to the control of a controller (not illustrated).

Hereinafter, movements for forming a yellow image in the first unit 10Y are described.

First, prior to the movements, the surface of the photoconductor 1Y is charged by the charging roller 2Y to a potential of −600 V to −800 V.

The photoconductor 1Y is formed by laminating a photosensitive layer on a substrate having conductivity (for example, volume resistivity at 20° C. of $1\times10^{-6}$ Ωcm or less). This photosensitive layer is generally high resistance (resistance of general resin), but has properties in which the specific resistance of the portion irradiated with the laser beams changes in a case where the photosensitive layer is irradiated with laser beams. Therefore, the charged surface of the photoconductor 1Y according to image data for yellow sent from the controller (not illustrated) is irradiated with the laser beams 3Y from the exposing device 3. Accordingly, an electrostatic charge image of a yellow image pattern is formed on the surface of the photoconductor 1Y.

The electrostatic charge image is an image formed on the surface of the photoconductor 1Y by charging and is a so-called negative latent image in which the specific resistance of the irradiated portion of the photosensitive layer decreases by the laser beams 3Y such that the charged electric charged on the surface of the photoconductor 1Y flows and charges of the portion not irradiated with the laser beam 3Y are retained.

The electrostatic charge image formed on the photoconductor 1Y rotates to a predetermined developing position according to the driving of the photoconductor 1Y. In this developing position, an electrostatic charge image on the photoconductor 1Y is developed as a toner image and visualized by a developing device 4Y.

The electrostatic charge image developer including at least a yellow toner and a carrier is accommodated in the developing device 4Y. The yellow toner is frictionally electrified by being stirred inside the developing device 4Y, and has charges having the polarity the same (negative polarity) as that of the charges charged on the photoconductor 1Y and is held on a roller (an example of developer holding member). As the surface of the photoconductor 1Y passes through the developing device 4Y, the yellow toner electrostatically adheres to the latent image portion discharged on the surface of the photoconductor 1Y, and the latent image is developed with the yellow toner. The photoconductor 1Y on which the yellow toner image is formed is subsequently moved at a predetermined speed, and the toner image developed on the photoconductor 1Y is transported to a predetermined primary transfer position.

In a case where the yellow toner image on the photoconductor 1Y is transported to the primary transfer position, a primary transfer bias is applied to the primary transfer roller 5Y, the electrostatic force directed from the photoconductor 1Y toward the primary transfer roller 5Y acts on the toner image, and the toner image on the photoconductor 1Y is transferred to the intermediate transfer belt 20. The transfer bias applied at this point has a polarity (+) opposite to the polarity (−) of the toner and is controlled to +10 μA, for example, by the controller (not illustrated) in the first unit 10Y. The toner retained on the photoconductor 1Y is removed by the photoconductor cleaning device 6Y and collected.

The primary transfer bias applied to the primary transfer rollers 5M, 5C, and 5K after the second unit 10M is also controlled in accordance with the first unit.

In this manner, the intermediate transfer belt 20 to which the yellow toner image has been transferred in the first unit 10Y is transported sequentially through the second to fourth units 10M, 10C, and 10K, toner images of respective colors are superimposed and transferred in a multiplex manner.

The intermediate transfer belt 20 on which the four color toner images are transferred in a multiplex manner through the first to fourth units reaches a secondary transfer portion including an intermediate transfer belt 20, the support roller 24 in contact with the inner surface of the intermediate transfer belt, and a secondary transfer roller (an example of the secondary transfer unit) 26 disposed on the image holding surface side of the intermediate transfer belt 20. On the other hand, recording paper (an example of a recording medium) P is fed to the gap between the secondary transfer roller 26 and the intermediate transfer belt 20 via a supply mechanism at a predetermined timing, and the secondary transfer bias is applied to the support roller 24.

The transfer bias applied at this point has a polarity (−) of polarity the same as the polarity (−) of the toner, and the electrostatic force directed from the intermediate transfer belt 20 toward the recording paper P acts on the toner image, and the toner image on the intermediate transfer belt 20 is transferred onto the recording paper P. The secondary transfer bias at this point is determined according to the resistance detected by a resistance detection unit (not illustrated) for detecting the resistance of the secondary transfer portion, and the voltage is controlled.

The recording paper P to which the toner image is transferred is sent to a pressure contact portion (nip portion) of a pair of fixing rollers in a fixing device (an example of the fixing unit) 28, a toner image is fixed on the recording paper P, and a fixed image is formed. The recording paper P on which fixing of the color image is completed is exported toward the discharging section, and the series of color image forming movements is ended.

Examples of the recording paper P to which the toner image is transferred include plain paper used for a copying machine or a printer in the electrophotographic method. Examples of the recording medium include an OHP sheet in addition to the recording paper P. In order to further improve the smoothness of the image surface after fixing, it is preferable that the surface of the recording paper P is also smooth. For example, coated paper obtained by coating the surface of plain paper with a resin or the like, art paper for printing, and the like may be preferably used.

Process Cartridge and Toner Cartridge

The process cartridge according to this exemplary embodiment is a process cartridge that includes a developing unit accommodating the electrostatic charge image developer according to this exemplary embodiment and developing an electrostatic charge image formed on the surface of the image holding member by the electrostatic charge image developer as the toner image and that is detachably attached to the image forming device.

The process cartridge according to this exemplary embodiment may have a configuration of including a developing unit and, for example, at least one selected from other units such as an image holding member, a charging unit, an electrostatic charge image forming unit, and a transfer unit, if necessary.

Hereinafter, an example of the process cartridge according to this exemplary embodiment is described, but the present invention is not limited thereto. In the description below, major portions illustrated in the drawings are described, and explanation of the others is omitted.

Figure 3:
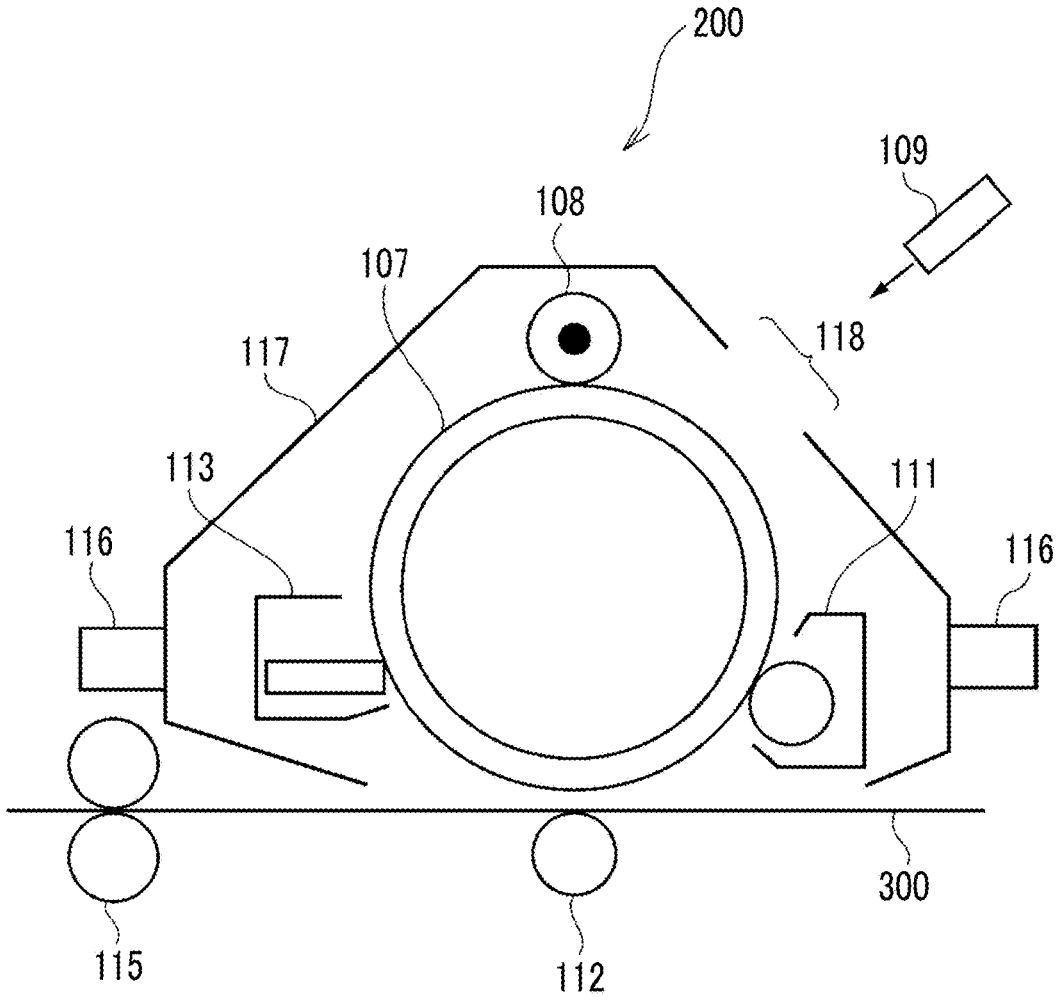
FIG. 3 is a schematic view illustrating a configuration of a process cartridge of this exemplary embodiment.

FIG. 3 is a schematic view illustrating the process cartridge according to this exemplary embodiment.

A process cartridge 200 illustrated in FIG. 3 became a cartridge combining and holding a photoconductor 107 (an example of the image holding member), a charging roller 108 (an example of the charging unit) around the photoconductor 107, a developing device 111 (an example of the developing unit), and a photoconductor cleaning device 113 (an example of the cleaning unit) in an integrated manner, for example, by a housing 117 including a mounting rail 116 and an opening 118 for exposure.

In FIG. 3, 109 indicates an exposing device (an example of the electrostatic charge image forming unit), 112 indicates a transfer device (an example of the transfer unit), 115 indicates a fixing device (an example of the fixing unit), and 300 indicates a recording paper (an example of the recording medium).

Subsequently, the toner cartridge according to this exemplary embodiment is described.

The toner cartridge according to this exemplary embodiment is a toner cartridge that includes a container that accommodates the toner according to this exemplary embodiment and is detachably attached to the image forming device. The toner cartridge includes the container that accommodates the replenishing toner for being supplied to the developing unit provided in the image forming device.

The image forming device illustrated in FIG. 2 is an image forming device having a configuration in which the toner cartridges 8Y, 8M, 8C, and 8K are detachably attached, and the developing devices 4Y, 4M, 4C, and 4K are connected to the toner cartridges corresponding to the respective colors by toner supply tubes (not illustrated). In a case where the toner that is accommodated in the container in the toner cartridge becomes less, this toner cartridge is replaced.

EXAMPLES

Hereinafter, the exemplary embodiment of the present invention is specifically described with reference to examples, but the present invention is not limited to these examples. Herein, unless otherwise specified, "part" and "%" are based on mass.

Manufacturing of Strontium Titanate Particle Strontium Titanate Particle (1)

0.7 mol of metatitanic acid which is a desulfurized and deflocculated titanium source as $TiO_2$ is sampled and put into a reaction container. Subsequently, 0.77 mol of a strontium chloride aqueous solution is added to the reaction container such that the $SrO/TiO_2$ molar ratio becomes 1.1. Subsequently, a solution obtained by dissolving lanthanum oxide in nitric acid is added to the reaction container in an amount in which lanthanum becomes 5 moles with respect to 100 moles of strontium. The initial concentration of $TiO_2$ in the mixture of the three materials is caused to be 0.75 mol/L.

Subsequently, the mixed solution is stirred, the mixed solution is heated to 90° C., the temperature of the liquid is maintained at 90° C., 153 mL of a 10 N sodium hydroxide aqueous solution is added over 3.8 hours under stirring, and stirring is continuously performed over one hour while the temperature of the liquid is maintained at 90° C. Subsequently, the reaction solution is cooled to 40° C., hydrochloric acid is added until pH becomes 5.5, and stirring is performed over one hour. Subsequently, the precipitate is washed by repeating decantation and dispersion in water. Hydrochloric acid is added to the slurry containing the washed precipitate, pH is adjusted to 6.5, and solid-liquid separation is performed by filtration.

Subsequently, an alcohol solution of i-butyltrimethoxysilane is added to the obtained solid content (strontium titanate particles) in an amount such that i-butyltrimethoxysilane becomes 20 parts with respect to 100 parts of the solid content, and stirring is performed over one hour.

Thereafter, solid-liquid separation is performed by filtration, and the solid content is dried over five hours in the atmosphere of 110° C., so as to obtain a strontium titanate particle (1).

Strontium Titanate Particles (2) to (14) and (16)

Strontium titanate particles (2) to (14) are manufactured in the same manner as the manufacturing of the strontium titanate particle (1) except for appropriately changing an used amount of metatitanic acid as $TiO_2$ [mol], an addition amount (SrO amount) [mol] of a strontium chloride aqueous solution, a $SrO/TiO_2$ molar ratio, an addition amount [mol]

of lanthanum with respect to 100 moles of strontium, an addition amount [mL] of a 10 N sodium hydroxide aqueous solution, an addition time [hour] of a 10 N sodium hydroxide aqueous solution, a type of hydrophobic treatment agent, a treatment amount (part) with respect to 100 parts of solid content, and a drying temperature [° C.] and drying time of the strontium titanate particle after the hydrophobic treatment as described in Table 1 below.

Strontium Titanate Particle (15)

A strontium titanate particle (15) is manufactured in the same manner as manufacturing of the strontium titanate particle (1), except for changing the alcohol solution of i-butyltrimethoxysilane to silicone oil (KF-96-100CS, manufactured by Shin-Etsu Chemical Co., Ltd.).

is added dropwise at a rate of 2 parts/min while the mixture is stirred. After the dropwise addition is completed, the temperature is returned to room temperature (20° C. to 25° C.), and bubbling is performed for 48 hours with dry nitrogen while stirring to obtain a resin particle dispersion in which ethyl acetate and 2-butanol are reduced to 1,000 ppm or less. Ion exchanged water is added to the resin particle dispersion, and the solid content is adjusted to 20 mass % so as to obtain a resin particle dispersion (1).

Preparing of Colorant Particle Dispersion (1)

Regal 330 (Carbon black manufactured by Cabot Corporation): 70 parts

Anionic surfactant (NEOGEN RK, manufactured by Daiichi Kogyo Seiyaku Co., Ltd.): 5 parts

TABLE 1

Strontium titanate particle as external additive

| | Manufacturing condition | | | | | | | | | | | |
|---|---|---|---|---|---|---|---|---|---|---|---|---|
| No. | $TiO_2$ [mol] | SrO [mol] | SrO/$TiO_2$ molar ratio | Addition amount of La [mol] | Addition amount of NaOH [mL] | Addition time of NaOH [hour] | Hydrophobic treatment agent | Treatment amount [part] | Drying temperature [° C.] | Drying time [hour] | Moisture content [%] | Molar ratio (Si/Sr) |
| (1) | 0.7 | 0.77 | 1.1 | 5 | 153 | 3.8 | i-Butyltrimethoxysilane | 15 | 110 | 5 | 3.3 | 0.09 |
| (2) | 0.7 | 0.77 | 1.1 | 5 | 153 | 3.8 | i-Butyltrimethoxysilane | 12 | 110 | 5.5 | 3.4 | 0.07 |
| (3) | 0.625 | 0.69 | 1.11 | 5 | 138 | 3.8 | i-Butyltrimethoxysilane | 12 | 110 | 5.5 | 3.4 | 0.07 |
| (4) | 0.7 | 0.77 | 1.1 | 2.5 | 153 | 3.8 | i-Butyltrimethoxysilane | 15 | 110 | 5 | 3.3 | 0.09 |
| (5) | 0.7 | 0.77 | 1.1 | 10 | 153 | 3.8 | i-Butyltrimethoxysilane | 15 | 110 | 5 | 3.3 | 0.09 |
| (6) | 0.7 | 0.77 | 1.1 | 5 | 153 | 1.2 | i-Butyltrimethoxysilane | 15 | 110 | 5 | 3.3 | 0.09 |
| (7) | 0.7 | 0.77 | 1.1 | 5 | 153 | 9.7 | i-Butyltrimethoxysilane | 15 | 110 | 5 | 3.3 | 0.09 |
| (8) | 0.7 | 0.77 | 1.1 | 2.5 | 153 | 3.8 | i-Butyltrimethoxysilane | 10 | 110 | 5.5 | 3.5 | 0.05 |
| (9) | 0.7 | 0.77 | 1.1 | 2.5 | 153 | 3.8 | i-Butyltrimethoxysilane | 25 | 110 | 4 | 3.1 | 0.16 |
| (10) | 0.7 | 0.77 | 1.1 | 0 | 153 | 3.8 | i-Butyltrimethoxysilane | 15 | 110 | 5 | 3.3 | 0.09 |
| (11) | 0.7 | 0.77 | 1.1 | 0 | 153 | 1 | i-Butyltrimethoxysilane | 12 | 110 | 5.5 | 3.4 | 0.07 |
| (12) | 0.7 | 0.77 | 1.1 | 5 | 153 | 12.0 | i-Butyltrimethoxysilane | 15 | 110 | 5 | 3.3 | 0.09 |
| (13) | 0.7 | 0.77 | 1.1 | — | 0 | 4.8 | None | 0 | 120 | 8 | 1.4 | 0 |
| (14) | 0.7 | 0.77 | 1.1 | — | 0 | 4.8 | i-Butyltrimethoxysilane | 15 | 110 | 5 | 3.2 | 0.09 |
| (15) | 0.7 | 0.77 | 1.1 | 5 | 153 | 3.8 | Silicone oil | 15 | 110 | 5 | 2.6 | 0.09 |
| (16) | 0.7 | 0.77 | 1.1 | 10 | 153 | 16 | i-Butyltrimethoxysilane | 25 | 110 | 5 | 3.1 | 0.16 |

Manufacturing of Toner Particle

Toner Particle (1)

Preparation of Resin Particle Dispersion (1)

Terephthalic acid: 30 mol parts

Fumaric acid: 70 parts by mole

Bisphenol A ethylene oxide adduct: 5 parts by mole

Bisphenol A propylene oxide adduct: 95 parts by mol

The above materials are introduced to a flask equipped with a stirrer, a nitrogen introduction pipe, a temperature sensor, and a rectification column, the temperature is raised to 220° C. over one hour, and 1 part of titanium tetraethoxide is added to 100 parts of the material. While generated water is distilled off, the temperature is raised to 230° C. over 30 minutes, the dehydration condensation reaction is continued for one hour at the temperature, and the reaction product is cooled. In this manner, a polyester resin having a weight-average molecular weight of 18,000 and a glass transition temperature of 60° C. is obtained.

40 parts of ethyl acetate and 25 parts of 2-butanol are introduced into a container equipped with a temperature regulating unit and a nitrogen replacing unit to obtain a mixed solvent, 100 parts of a polyester resin is gradually added and dissolved, and 10 mass % of an ammonia aqueous solution (equivalent to 3 times by the molar ratio with respect to the acid value of the resin) are put, and stirring is performed over 30 minutes. Subsequently, the inside of the container is replaced with dry nitrogen, the temperature is maintained at 40° C., and 400 parts of ion exchanged water Ion exchanged water: 200 parts The materials are mixed and dispersed for 10 minutes by using a homogenizer (trade name ULTRA-TURRAX T50 manufactured by IKA-Werke GmbH & Co. KG). Ion exchanged water is added such that the solid content in the dispersion became 20 mass % so as to obtain a colorant particle dispersion (1) in which colorant particles having a volume average particle diameter of 170 nm are dispersed.

Preparation of Releasing Agent Particle Dispersion (1)

Paraffin wax (Nippon Seiro Co., Ltd., HNP-9): 100 parts

Anionic surfactant (NEOGEN RK, manufactured by Daiichi Kogyo Seiyaku Co., Ltd.): 1 part Ion exchanged water: 350 parts The materials are mixed, heated to 100° C., dispersed using a homogenizer (IKA-Werke GmbH & Co. KG, trade name ULTRA-TURRAX T50), and performing a distribution treatment a MANTON GAULIN high pressure homogenizer (Gaulin Co., Ltd.), to obtain a releasing agent particle dispersion (1) (solid content amount: 20 mass %) having a volume average particle diameter of 200 nm.

Manufacturing of Toner Particle (1)

Resin particle dispersion (1): 403 parts

Colorant particle dispersion (1): 12 parts

Releasing agent particle dispersion (1): 50 parts

Anionic surfactant (TaycaPower): 2 parts

The materials are introduced in a round stainless steel flask, 0.1 N nitric acid is added such that pH is adjusted to 3.5, and 30 parts of a nitric acid aqueous solution having a polyaluminum chloride concentration of 10 mass % is added. Subsequently, the mixture is dispersed at a liquid temperature of 30° C. using a homogenizer (IKA-Werke GmbH & Co. KG, trade name ULTRA TURRAX T50), heated to 45° C. in a heating oil bath, and maintained for 30 minutes. Thereafter, 100 parts of the resin particle dispersion (1) is added and maintained for 1 hour, a 0.1 N sodium hydroxide aqueous solution is added, pH is adjusted to 8.0, and the mixture is heated to 84° C. and maintained for 2.5 hours. Subsequently, the mixture was cooled to 20° C. at a rate of 20° C./min, filtrated, sufficiently washed with ion exchanged water, and dried, so as to obtain a toner particle (1).

The volume average particle diameter of the obtained toner particle (1) is 5.7 μm, and the average circularity is 0.95.

Toner Particle (2)

A toner particle (2) is manufactured in the same manner as in the manufacturing of toner particle (1) except for adding 100 parts of the resin particle dispersion (1), maintaining for one hour, adjusting pH to 8.0 by adding a 0.1 N sodium hydroxide aqueous solution, heating the mixture to 84° C., and maintaining the mixture for 2.0 hours.

The volume average particle diameter of the obtained toner particle (2) is 5.7 μm, and the average circularity is 0.93.

Toner Particle (3) Preparation of Colorant Particle Dispersion (W)

Titanium oxide particles (manufactured by Ishihara Sangyo Kaisha, Ltd., Product name: CR-60-2): 210 parts Anionic surfactant (NEOGEN RK, manufactured by DKS Co. Ltd.): 10 parts Ion exchanged water: 480 parts The above components are mixed and stirred for 30 minutes using a homogenizer (IKA-Werke GmbH & Co. KG, trade name ULTRA-TURRAX T50) and performing a distribution treatment in a high pressure impact type dispersing machine ULTIMIZER (HJP 30006: manufactured by Sugino Machine Limited) for one hour, so as to obtain a white pigment particle dispersion (W) (solid content of 30 mass %) in which a white pigment having a volume average particle diameter of 210 nm is dispersed.

Preparation of Toner Particle (3)

Ion exchanged water: 600 parts

Resin particle dispersion (1): 400 parts

Colorant particle dispersion (W): 325 parts

Releasing agent particle dispersion (1): 78 parts

Anionic surfactant (Tayca Power): 8 parts

The material is introduced into a round stainless steel flask, 0.1 N of nitric acid is added, pH is adjusted to 3.5, and 13 parts of a nitric acid aqueous solution having a polyaluminum chloride concentration of 10 mass % is added. Subsequently, the mixture is dispersed at a liquid temperature of 30° C. using a homogenizer (IKA-Werke GmbH & Co. KG, trade name ULTRA TURRAX T50), heated to 45° C. in a heating oil bath, and maintained for 60 minutes.

Thereafter, 100 parts of the resin particle dispersion (1) is added and maintained for one hour, a 0.1 N sodium hydroxide aqueous solution is added, pH is adjusted to 8.5, and the mixture is heated to 85° C. and maintained for five hours. Subsequently, the mixture is cooled to 20° C. at a rate of 20° C./min, filtrated, sufficiently washed with ion exchanged water, and dried, so as to obtain a toner particle (3) which is a white toner particle.

The volume average particle diameter of the obtained toner particle (3) is 7.5 μm, and the average circularity is 0.95.

Manufacturing of Carrier

A carrier is used one manufactured as follows.

Ferrite particle (volume average particle diameter: 36 μm) 100 parts

Toluene: 14 parts

Styrene-methyl methacrylate copolymer: 2 parts (Component ratio: 90/10, Mw=80,000)

Carbon black (R330: manufactured by Cabot Corporation): 0.2 parts

First, the components other than ferrite particles are stirred for 10 minutes with a stirrer so as to prepare a dispersed coating liquid, this coating liquid and ferrite particles are introduced to in a vacuum degassing type kneader, and stirred for 30 minutes at 60° C., further deaired by reducing the pressure while heating, and dried so as to obtain the carrier.

Manufacturing Toner and Developer: Example 1

0.95 parts of a strontium titanate particle (1) as an external additive is added to 100 parts of the toner particle (1), stirred by a HENSCHEL MIXER, at a stirring circumferential speed of 30 m/sec for 15 minutes, so as to obtain a toner.

Each obtained toner and a carrier are placed in a V blender at a ratio of toner:carrier=8:92 (mass ratio) and stirred for 20 minutes so as to obtain a developer.

Manufacturing Toner and Developer: Examples 2 to 11 and 13, Comparative Examples 1 to 4

Toners and developers are manufactured in the same manner as in Example 1 except for changing the strontium titanate particle (1) to strontium titanate particles presented in Table 2.

Manufacturing Toner and Developer: Example 12

Toners and developers are manufactured in the same manner as in Example 1 except for changing the toner particle (1) to a toner particle (2).

Manufacturing of Toner and Developer: Example 14

A toner and a developer are manufactured in the same manner as in Example 1 except for changing the toner particle (1) to the toner particle (3).

Various Analysis

Shape Properties of Strontium Titanate Particle

Images of the toners are taken at a magnification of 40,000 times by using a scanning electron microscope (SEM) (S-4800 manufactured by Hitachi High-Technologies Corporation) equipped with an EDX device (EMAX Evolution X-Max 80 $mm^2$) manufactured by Horiba, Ltd.). 300 or more primary particles of strontium titanate are specified by EDX analysis from within one visual field based on the presence of Ti and Sr. Observation is performed with the SEM at an accelerating voltage of 15 kV, an emission current of 20 μA, and WD of 15 mm, and the EDX analysis is conducted under the same conditions for a detection time of 60 minutes.

The specified strontium titanate particle is analyzed with image processing analysis software WinRoof (Mitani Corporation) and a circle equivalent diameter, an area, and a perimeter of each primary particle image are obtained, so as to obtain Circularity=4n×(area)/(peripheral length)$^2$. In the circle equivalent diameter distribution, the circle equivalent diameter which becomes 50% of the accumulation from the small diameter side is caused to be the average primary particle diameter, the circularity which becomes 50% of the accumulation from the smaller side in the circularity distribution is caused to be the average circularity, and circularity which becomes 84% of the accumulation from the smaller side in the circularity distribution is caused to be the cumulative 84% circularity. The standard deviation is also obtained from the distribution of circularity.

The obtained values are collectively presented in Table 2.

Surface Coverage

With respect to the toner, the surface coverage is measured in the measuring condition.

Results thereof are as presented in Table 2.

X-Ray Diffraction of Strontium Titanate Particle

Each of the strontium titanate particles before being externally added to the toner particles is subjected to the crystal structure analysis as a sample, by the X-ray diffraction method under the measurement conditions.

The strontium titanate particles (1) to (10) have peaks corresponding to the peak of the (110) plane of the perovskite crystal near the diffraction angle of 20=32°, and the half-width of each peak is in the range of 0.2° or more and 0.5° or less.

Moisture Content of Strontium Titanate Particle

A moisture content is measured in the measuring method by using each of the strontium titanate particles before being externally added to the toner particles as a sample.

The measuring results are provided in Table 1.

Mass Ratio (Si/Sr) of Strontium Titanate Particle

A mass ratio (Si/Sr) is measured in the measuring method by using each of the strontium titanate particles before being externally added to the toner particles as a sample.

The measuring results are provided in Table 1.

Average Circularity of Toner Particle

Toner particles before externally adding external additives are analyzed with a flow type particle image analyzer (FPIA-3000, manufactured by Sysmex Corporation), circularity=(perimeter of a circle having the same area as the particle projected image)/(a circumferential length of the particle projected image) was determined, and the circularity which becomes 50% of the accumulation from the small side in the circularity distribution of 3000 toner particles is caused to be the average circularity of the toner particles.

In a case where external additives are externally added to the toner particles, the measurement is performed after external additives having a relatively large particle diameter (for example, external additives having a primary particle diameter of 100 nm or more) are removed. The operation of removing the external additive is as follows.

40 mL of a 0.2 mass % aqueous solution of TRITON X-100 (manufactured by Acros Organics B.V.B.A.) and 2 g of the toner are introduced to a 200 mL glass bottle and stirred 500 times so as to be dispersed. Subsequently, ultrasonic waves are applied by using an ultrasonic homogenizer (US-300AT, manufactured by Nippon Seiki Co., Ltd.) while the liquid temperature of the dispersion is maintained at 20° C.±0.5° C. Ultrasonic wave application is continuously performed for application time: 300 seconds, output: 75 W, amplitude: 180 μm, and a distance between the ultrasonic transducer and the bottom of the container: 10 mm. Subsequently, the dispersion is centrifuged at 3,000 rpm for 2 minutes at a cooling temperature of 0° C. by using a small high-speed cooling centrifuger (manufactured by Sakuma Seisakusho Co., Ltd, M201-IVD), the supernatant is removed, and the remaining slurry is filtrated through filter paper (manufactured by Advantech Co., Ltd., qualitative filter paper No. 5C, 110 nm). The residue on the filter paper is washed twice with ion exchanged water and dried so as to obtain a measurement sample.

Evaluation

The obtained developers of each example are accommodated in a developing device of a modified machine of an image forming device "ApeosPort-IV C5575 (manufactured by Fuji Xerox Co., Ltd.)" (a modified machine with a concentration automatic control sensor disconnected in environmental fluctuation).

Fogging evaluation in a case where immediately after the power source of the image forming device is connected and 30 images of 1% image density are continuously output to A4 paper is performed in each of the high temperature and high humidity environment (under the environment of 28° C./85% RH) and the low temperature and low humidity environment (under the environment of 10° C./15% RH), by using the remodeled machine of this image forming device. The evaluation results are provided in Table 2.

The evaluation standard is as below. G1: Fogging is not recognized in all of the 30 sheets. G2: Fogging is slightly recognized in one sheet, but in an acceptable range in practice. G3: Fogging is slightly recognized in plural sheets, but in an acceptable range in practice. G4: Fogging is clearly recognized in plural sheets, and is not suitable in practice. G5: Fogging is totally recognized in all of the 30 sheets.

TABLE 2

| | Strontium titanate particle | | | | | | Toner particle | | | Fogging evaluation | |
|---|---|---|---|---|---|---|---|---|---|---|---|
| | | Average | Physical measurement value | | | | | Physical measurement value | | | |
| | No. | primary particle diameter [nm] | Average circularity | Cumulative 84% circularity | Standard deviation | Surface coating ratio [%] | No. | Volume average particle diameter [μm] | Average circularity | In high temperature and high humidity | In low temperature and low humidity |
| Example 1 | (1) | 50 | 0.88 | More than 0.92 | 0.0717 | 15 | (1) | 5.7 | 0.95 | G1 | G1 |
| Example 2 | (2) | 50 | 0.88 | More than 0.92 | 0.0420 | 15 | (1) | 5.7 | 0.95 | G1 | G2 |
| Example 3 | (3) | 50 | 0.88 | More than 0.92 | 0.1000 | 15 | (1) | 5.7 | 0.95 | G2 | G2 |
| Example 4 | (4) | 50 | 0.82 | More than 0.92 | 0.0950 | 15 | (1) | 5.7 | 0.95 | G3 | G3 |
| Example 5 | (5) | 50 | 0.94 | More than 0.92 | 0.0420 | 15 | (1) | 5.7 | 0.95 | G3 | G2 |
| Example 6 | (6) | 30 | 0.89 | More than 0.92 | 0.0700 | 15 | (1) | 5.7 | 0.95 | G3 | G3 |
| Example 7 | (7) | 78 | 0.88 | More than 0.92 | 0.0710 | 15 | (1) | 5.7 | 0.95 | G3 | G3 |
| Example 8 | (8) | 50 | 0.88 | More than 0.92 | 0.0680 | 15 | (1) | 5.7 | 0.95 | G3 | G3 |
| Example 9 | (9) | 50 | 0.88 | More than 0.92 | 0.0723 | 15 | (1) | 5.7 | 0.95 | G2 | G3 |

TABLE 2-continued

| | Strontium titanate particle | | | | | | Toner particle | | | Fogging evaluation | |
|---|---|---|---|---|---|---|---|---|---|---|---|
| | | Average | Physical measurement value | | | | | Physical measurement value | | | |
| | No. | primary particle diameter [nm] | Average circularity | Cumulative 84% circularity | Standard deviation | Surface coating ratio [%] | No. | Volume average particle diameter [μm] | Average circularity | In high temperature and high humidity | In low temperature and low humidity |
| Example 10 | (10) | 50 | 0.88 | More than 0.92 | 0.0400 | 15 | (1) | 5.7 | 0.95 | G2 | G2 |
| Example 11 | (15) | 50 | 0.88 | More than 0.92 | 0.0717 | 15 | (1) | 5.7 | 0.95 | G3 | G3 |
| Example 12 | (1) | 50 | 0.88 | More than 0.92 | 0.0717 | 15 | (2) | 5.7 | 0.93 | G1 | G1 |
| Example 13 | (12) | 90 | 0.86 | More than 0.92 | 0.0750 | 15 | (1) | 5.7 | 0.95 | G3 | G3 |
| Example 14 | (1) | 50 | 0.88 | More than 0.92 | 0.0717 | 15 | (3) | 7.5 | 0.95 | G1 | G1 |
| Comparative Example 1 | (11) | 19 | 0.90 | 0.92 or less | 0.0420 | 15 | (1) | 5.7 | 0.95 | G4 | G4 |
| Comparative Example 2 | (13) | 90 | 0.88 | 0.92 or less | 0.0350 | 15 | (1) | 5.7 | 0.95 | G5 | G5 |
| Comparative Example 3 | (14) | 90 | 0.88 | 0.92 or less | 0.0350 | 15 | (1) | 5.7 | 0.95 | G5 | G4 |
| Comparative Example 4 | (16) | 110 | 0.88 | More than 0.92 | 0.004 | 15 | (1) | 5.7 | 0.95 | G5 | G4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle; and a strontium titanate particle that is externally added to the toner particle, wherein an average primary particle diameter of the strontium titanate particle that is present on a surface of the toner particle is 30 nm or more and 100 nm or less, and average primary particle circularity is 0.82 or more and 0.94 or less, and wherein circularity that becomes 84% of accumulation of the primary particle is greater than 0.92.

2. The electrostatic charge image developing toner according to claim 1, wherein the strontium titanate particle that is present on the surface of the toner particle has a standard deviation of primary particle circularity of 0.04 or more and 2.0 or less.

3. The electrostatic charge image developing toner according to claim 2, wherein the strontium titanate particle that is present on the surface of the toner particle has a standard deviation of primary particle circularity of 0.04 or more and 1.0 or less.

4. The electrostatic charge image developing toner according to claim 1, wherein a moisture content of the strontium titanate particle is 1.5% or more and 10% or less.

5. The electrostatic charge image developing toner according to claim 4, wherein a moisture content of the strontium titanate particle is 2% or more and 5% or less.

6. The electrostatic charge image developing toner according to claim 1, wherein the strontium titanate particle has a hydrophobized surface.

7. The electrostatic charge image developing toner according to claim 6, wherein the strontium titanate particle has a surface subjected to a hydrophobic treatment with a silicon-containing organic compound.

8. The electrostatic charge image developing toner according to claim 7, wherein the strontium titanate particle has the surface including the silicon-containing organic compound by 5 mass % or more and 30 mass % or less with respect to a mass of the strontium titanate particle.

9. The electrostatic charge image developing toner according to claim 8, wherein the strontium titanate particle has the surface including the silicon-containing organic compound by 10 mass % or more and 25 mass % or less with respect to the mass of the strontium titanate particle.

10. The electrostatic charge image developing toner according to claim 7, wherein the silicon-containing organic compound is at least one selected from the group consisting of an alkoxysilane compound and silicone oil.

11. The electrostatic charge image developing toner according to claim 7, wherein a mass ratio (Si/Sr) of silicon (Si) and strontium (Sr) of the strontium titanate particle calculated from a qualitative and quantitative analysis by fluorescent X-ray analysis is 0.025 or more and 0.25 or less.

12. The electrostatic charge image developing toner according to claim 1, wherein surface coverage of the strontium titanate particle with respect to the toner particle is 3% or more and 50% or less.

13. The electrostatic charge image developing toner according to claim 12, wherein surface coverage of the strontium titanate particle with respect to the toner particle is 3% or more and 30% or less.

14. The electrostatic charge image developing toner according to claim 1, wherein the strontium titanate particle is a strontium titanate particle doped with a metal element other than titanium and strontium.

15. The electrostatic charge image developing toner according to claim 14, wherein the strontium titanate particle is a strontium titanate particle doped with lanthanum.

16. The electrostatic charge image developing toner according to claim 1, wherein the strontium titanate particle that is present on the surface of the toner particle has an average primary particle diameter of 30 nm or more and 80 nm or less.

17. The electrostatic charge image developing toner according to claim 16, wherein the strontium titanate particle that is present on the surface of the toner particle has an average primary particle diameter of 30 nm or more and 60 nm or less.

18. The electrostatic charge image developing toner according to claim 1, wherein average circularity of the toner particle is 0.91 or more and 0.98 or less.

19. The electrostatic charge image developing toner according to claim 18, wherein average circularity of the toner particle is 0.93 or more and 0.97 or less.

20. The electrostatic charge image developing toner according to claim 1, wherein the toner particle is a white toner particle.

* * * * *